US011649100B2

(12) United States Patent
Moak et al.

(10) Patent No.: US 11,649,100 B2
(45) Date of Patent: May 16, 2023

(54) PACKAGE FOR IRREGULAR SHAPED OBJECTS

(71) Applicant: BIG HEART PET, INC., Orrville, OH (US)

(72) Inventors: Morgan Pearl Moak, Cuyahoga Falls, OH (US); Andrew Douglas Gordon, Medina, OH (US); Randall Burt Cotton, Topeka, KS (US)

(73) Assignee: BIG HEART PET, INC., Orrville, OH (US)

( * ) Notice: Subject to any disclaimer, the term of this patent is extended or adjusted under 35 U.S.C. 154(b) by 236 days.

(21) Appl. No.: 16/522,094

(22) Filed: Jul. 25, 2019

(65) Prior Publication Data

US 2021/0024268 A1 Jan. 28, 2021

(51) Int. Cl.

| | |
|---|---|
| ***B65D 77/04*** | (2006.01) |
| ***B65D 77/26*** | (2006.01) |
| ***B65B 5/06*** | (2006.01) |
| ***B65B 11/00*** | (2006.01) |

(52) U.S. Cl.

CPC ..... *B65D 77/0406* (2013.01); *B65B 5/06* (2013.01); *B65B 11/00* (2013.01); *B65D 77/26* (2013.01)

(58) Field of Classification Search

CPC .. B65B 5/062; B65D 77/0406; B65D 77/0413

USPC ..... 220/23.88, 495.03, 62.13; 99/448; 229/103.2, 87.08, 906, 904.1, 902

See application file for complete search history.

(56) References Cited

U.S. PATENT DOCUMENTS

| | | | | |
|---|---|---|---|---|
| 639,967 | A | 12/1899 | Freeman et al. | |
| 1,602,254 | A * | 10/1926 | Schindler | B65D 5/26 229/164.1 |
| 1,949,161 | A * | 2/1934 | Haug | B65D 75/38 206/777 |
| 2,334,425 | A | 11/1943 | Lowey | |
| 3,315,868 | A * | 4/1967 | Hempfling | B65D 5/68 229/125.19 |
| 3,368,528 | A | 2/1968 | Ganoe | |
| 3,412,425 | A | 11/1968 | Sturm | |
| 4,299,850 | A * | 11/1981 | Wallen | B65D 71/10 206/499 |

(Continued)

FOREIGN PATENT DOCUMENTS

WO WO-0181200 A1 * 11/2001 ..... B65D 81/343

OTHER PUBLICATIONS

Office Action/Restriction Requirement dated Apr. 30, 2020 in Design U.S. Appl. No. 29/701,467.

*Primary Examiner* — Rafael A Ortiz

(74) *Attorney, Agent, or Firm* — Michael A. Olshavsky

(57) ABSTRACT

A carrier and related methods of use are provided for packaging irregular-shaped products. The carrier has a footing and a vertical support member partially enclosing at least one irregular-shaped product. The vertical support member has: (1) a pair of sidewalls facing one another and having lower tabs joined to opposite ends of the footing, and (2) a rear wall with edges along the junctures with the sidewalls and a lower edge along the juncture with the footing. A wrap encloses the irregular-shaped product(s) and the carrier. The method includes uniformly aligning the irregular-shaped product(s) in the carrier and securing the carrier and product (s) by enclosing them with a wrap.

8 Claims, 25 Drawing Sheets

(56) References Cited

U.S. PATENT DOCUMENTS

| | | | | |
|---|---|---|---|---|
| 4,364,925 | A | 12/1982 | Fisher | |
| 4,557,219 | A | 12/1985 | Edwards | |
| 4,848,543 | A * | 7/1989 | Doboze | B65D 43/162 220/4.23 |
| 5,297,984 | A | 3/1994 | Gagliardi, Jr. | |
| 5,419,283 | A | 5/1995 | Leo | |
| 5,609,913 | A | 3/1997 | Welch | |
| 5,743,402 | A * | 4/1998 | Gics | B65D 77/0433 206/459.5 |
| 6,200,616 | B1 | 3/2001 | Axelrod et al. | |
| 6,896,924 | B2 | 5/2005 | Hernandez et al. | |
| 7,410,662 | B1 | 8/2008 | Tsengas | |
| 7,485,330 | B2 | 2/2009 | Anderson et al. | |
| 9,737,053 | B2 | 8/2017 | Barnvos et al. | |
| 2003/0071036 | A1* | 4/2003 | Savage | B65D 81/3453 219/730 |
| 2003/0087008 | A1 | 5/2003 | Axelrod | |
| 2004/0175477 | A1* | 9/2004 | Walter | A21D 13/41 426/549 |
| 2005/0274780 | A1* | 12/2005 | Charlton | B65D 33/04 229/110 |
| 2006/0102099 | A1 | 5/2006 | Edwards | |
| 2008/0014311 | A1 | 1/2008 | Tepper et al. | |
| 2009/0120372 | A1 | 5/2009 | Townsend et al. | |
| 2015/0147435 | A1* | 5/2015 | Rettey | A21C 11/02 425/297 |
| 2021/0024268 | A1 | 1/2021 | Moak et al. | |

* cited by examiner

PACKAGE FOR IRREGULAR SHAPED OBJECTS

FIELD OF THE INVENTION

The invention relates generally to the field of packing articles in packaging for sale. More specifically, the invention relates to a carrier package with a stabilizing footing for packing irregular-shaped products and includes use of the carrier package in a commercial process for assembling retail-ready or shelf-ready packaging.

BACKGROUND OF THE INVENTION

Irregular-shaped consumer products pose unique challenges regarding controlling, and uniformly and stably packing such products throughout the packing process, and later downstream when transporting and displaying the packaged product at the point-of-sale.

More specifically, the packing process for irregular-shaped, consumable products poses unique challenges because irregular-shaped products are difficult to handle and uniformly align in the packing process, making them difficult to efficiently and securely pack within the packaging. For example, placing an irregular-shaped product in a continuous flow wrap process can be time consuming because the product needs to be positioned properly within a container and generally immobilized from the time of placement through to sealing of the product within the package.

Another challenge with packing irregular-shaped products involves difficulties in effectively aligning and securing the products within the packaging to eliminate or avoid excessive movement of the products within the packaging once the packaging is sealed. Excessive movement of the products in packaging increases the risk of breakage, which can cause loss of product and/or a loss of sales due to poor consumer perception of product quality.

A further challenge unique to packing irregular-shaped products involves excessive empty space within the internal packing volume of the packaging, which arises because irregular-shaped products do not largely fill the total amount of internal packing volume inside packaging. The empty space is wasted space, and this adds up when multiple packages are packed within larger containers for shipment. Empty space can increase shipping costs because more containers must be shipped to ensure that enough product reaches the point of sale location to meet product demand.

One approach for packing irregular-shaped products includes loosely packaging the products in bulk, in a bag or box. However, bulk packaging fails to properly secure the products and can result in undesirable settling and breakage of the products in the bag or box during transport. Another approach includes securing irregular-shaped products in a container using blister packs, or bubble wrap or other packing material, within a container. Yet again, securely packaging or fitting product in any type of container using blister packs or bubble wrap is inefficient because it adds materials and time-consuming steps to the packing process. A further approach includes attaching irregular-shaped products to a hanging display, such as a flat piece of cardboard or other material. Unfortunately, this approach can result in product being inefficiently packaged in a bulky, an unwieldy, and/or a loose manner, which exposes product to breakage and fails to maximize use of internal packing volume in a package. While the previously-mentioned approaches for packing irregular-shaped products, e.g., bulk packing, unsecured packing, and individual packing, are well-known and used in commercial lines, these approaches fail to resolve the persistent challenges for packing irregular-shaped products.

Accordingly, there is a need for a carrier package with a footing for securely packing irregular-shaped products throughout a commercial packing process, as well as for stabilizing product during transportation and when displayed upright in retail-ready or shelf-ready packaging at the point of sale. There is a need for a carrier package that: (i) provides efficiency and uniform alignment in the packing process, while avoiding costly materials and time-consuming packing steps; (ii) securely packages irregular-shaped product within individual packages, as well as multiple packages within a display tray, to avoid breakage during transport and display at the point of sale; (iii) maximizes packed product density in a container, while conversely minimizing empty internal packing volume within each individual container; and (iv) adds convenience in distribution, handling, stacking, display and sale.

SUMMARY OF THE INVENTION

The invention overcomes one or more of the challenges of the traditional approaches to packing irregular-shaped products. To achieve solutions for the foregoing needs and to provide other advantages, and according to the purpose of the invention as embodied and described herein, the invention provides for uniform alignment and secure packing of irregular-shaped products in packaging with minimal empty internal packing volume.

The invention provides a carrier package containing at least one securely-aligned, irregular-shaped consumable product, and methods of assembly thereof. The carrier package includes a carrier formed from a foldable, rigid or semi-rigid, sheet material. The carrier has a footing and a vertical support member, the internal surfaces of which provide internal surfaces of a packing compartment. The carrier facilitates alignment and partial enclosure of the at least one irregular-shaped consumable product in the packing compartment of the carrier. The vertical support member has: (1) a pair of sidewalls, which are facing one another, that form lower edges at opposite ends of the footing, and (2) a rear wall having edges formed along the sidewalls and another edge along the footing. The footing and vertical support members provide a packing compartment. A wrap encloses the irregular-shaped product and the carrier. The wrap also secures the irregular-shaped, consumable product aligned within the carrier. The carrier also provides support to stand the irregular-shaped consumable product upright within the package for display at the point of sale. The footing, i.e., the stabilizing base, is operatively connected with the vertical support member and provides structure that supports the irregular-shaped product(s) aligned in the carrier to stand upright on a generally flat surface without tipping.

In various embodiments, the irregular-shaped product comprises an elongate shape. For example, the irregular-shaped product can be a consumable product like a pet chew or pet treat, or any other irregular-shaped consumable or non-consumable product for animals or humans.

In various embodiments, the sheet material used to make the carrier can be a paper-based material including, but not limited to, paperboard, cardboard, kraft board, corrugated cardboard, carton board, or paperboard laminates. The paper-based sheet material can be recycled and/or recyclable. The paper-based sheet material can have a coating or laminate applied to its surface that contacts the irregular-shaped product, whereby the coating prevents the transfer of ingredients, e.g., oil, flavor, or moisture, from the product to the sheet material. The carrier can also be made from a plastic material including, but not limited to, polypropylene (PP), polyethylene terephthalate (PET), high density polyethylene (HDPE), low density polyethylene (LDPE), polycarbonate, polystyrene, or polyvinyl chloride. The plastic material can be selected from food grade plastics.

In embodiments, the footing, the sidewalls, and the rear wall can form a generally 3-dimensional shape that can be square or rectangular.

In an embodiment, the wrap is made from a plastic material, which can also be selected as a food grade plastic. The wrap can also be transparent, printed with graphics or color, or a combination thereof. The wrap can be folded and/or sealed.

In an embodiment, the pair of facing sidewalls have tabs secured to the footing, and the pair of sidewalls form edges with the rear wall and the footing.

In an embodiment, the carrier can include a divider running substantially parallel to and between the sidewalls. The divider delineates two packing compartments for irregular-shaped products and prevents the products from contacting one another.

In an embodiment, a display tray is provided for holding multiple wrapped carriers that can be later packed in larger containers for transportation to, and display at, the point-of-sale. The display tray can be made from paper-based or plastic material.

In an embodiment, a retail ready packaging is provided comprising a display tray filled with from 2 to 5 carriers in an upright and parallel configuration. Each carrier comprises a packing compartment defined by a footing operatively connected to a vertical support member and the footing and a vertical support member align and partially enclose at least one irregular-shaped consumable product in the packing compartment of each carrier. The footing of each carrier enables each carrier to maintain the upright and parallel configuration with respect to every other carrier in the display tray.

A method for packing irregular-shaped, elongate consumable products is also provided. The method includes first placing at least one irregular-shaped product within a carrier comprising: a footing and a vertical support member, the vertical support member having a pair of sidewalls facing one another and forming lower edges where joined to opposite ends of the footing, and a rear wall having vertical edges joined to vertical edges of the sidewalls and a lower edge joined to the footing. Next, the method includes contacting an end portion of the irregular-shaped product against the footing and side portions of the product against the rear wall and at least one of the sidewalls. In an embodiment, the method includes placing a second irregular-shaped product within the carrier in contact with the first irregular-shaped product, whereby the two irregular-shaped products align and interlock with one another, i.e., nest together, within the packing compartment of the carrier. Then, the method includes forming a packaged product, i.e., carrier package, by securing the irregular-shaped product within the carrier using a wrap enclosing the carrier and the irregular-shaped product in a generally symmetric, uniform 3-dimensional shape having a minimum amount of empty packing volume. Consequently, the carrier package can stand upright on the footing, i.e., stabilizing base, whether alone or packaged with other carrier packages in a display tray or other container.

In an embodiment, the method includes hermetically sealing the wrap to enclose the irregular-shaped products in the packing compartment of the carrier.

In summary, the solutions provided by the invention maximize the density of the irregular-shaped product packed in the carrier with efficient use of internal packing space of the packing compartment, by aligning and securing the irregular-shaped products for storage, shipment, and display at a point-of-sale.

BRIEF DESCRIPTION OF THE FIGURES

Additional aspects, features, and advantages of the invention, as to its structure, assembly, and use, will be understood and become clearer when the invention is considered in view of the following brief description of the figures made in conjunction with the accompanying drawings, wherein.

DETAILED DESCRIPTION OF THE INVENTION

Figure 1:
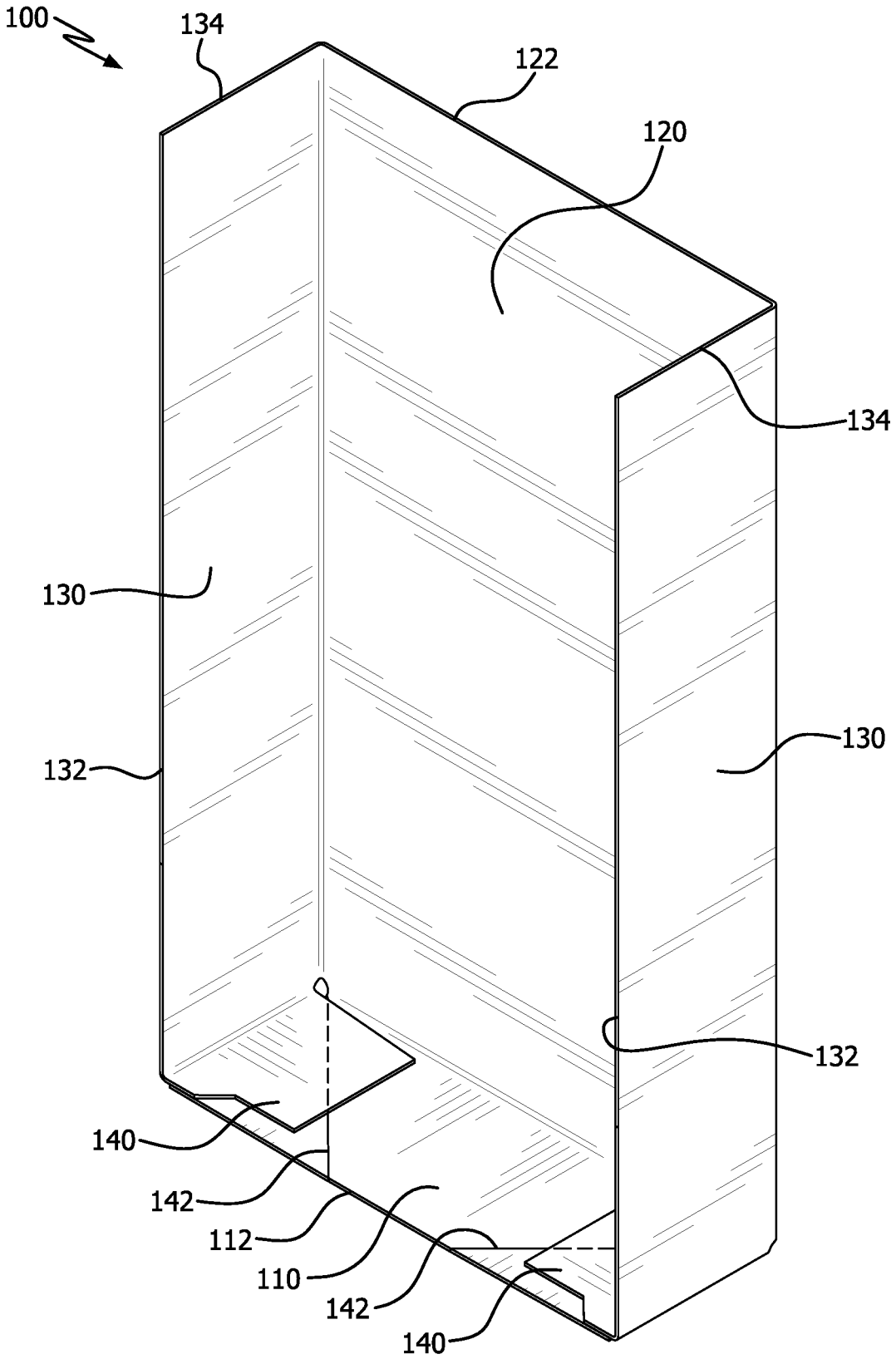
FIG. 1 shows a front perspective view of a carrier for enclosing two irregular-shaped products.

Illustrative and alternative embodiments of carrier 100, 200 with footing 110, 210 used for packaging irregular-shaped, consumable products are described in detail with reference being made to the figures of this application. While similar aspects of embodiments of the invention are featured throughout this disclosure, these similarities may be repeated within the context of the various embodiments of the invention.

Referring generally to FIGS. 1-11, carrier 100 is shown. Carrier 100 includes footing 110 that is either connected to, or contiguous with, the material used to form rear wall 120, as shown, for example, in FIGS. 1-11. Footing 110 and rear wall 120 are either connected to, or contiguous with, a pair of opposite sidewalls 130, as shown, in FIGS. 1-11. Carrier 100 is useful for aligning and securely packing irregular-shaped products 150 in a packing compartment and displaying products 150 for sale. Specifically referring to FIG. 11, carrier 100 enclosing irregular-shaped products 150 securely within wrap 180 forms carrier package 10.

In the non-limiting embodiment shown, for example, in FIGS. 1-3A, 6 and 8, tabs 140 are provided at ends of opposite sidewalls 130 and are adhered with an adhesive to, or structurally connected with, either the top (or bottom) surface of footing 110. This operatively connects opposite sidewalls 130 with footing 110 and forms two corners at the lower, rear portion of carrier 100. The corners provide carrier 100 with structural stability to align and to secure irregular-shaped products 150. In certain embodiments, footing 110 and tabs 140 can be scored or have fold lines 142, shown in FIGS. 1-2 and 6-7, that permit footing 110 and tabs 140 to be folded inward against an interior surface of rear wall 120.

Figure 8:
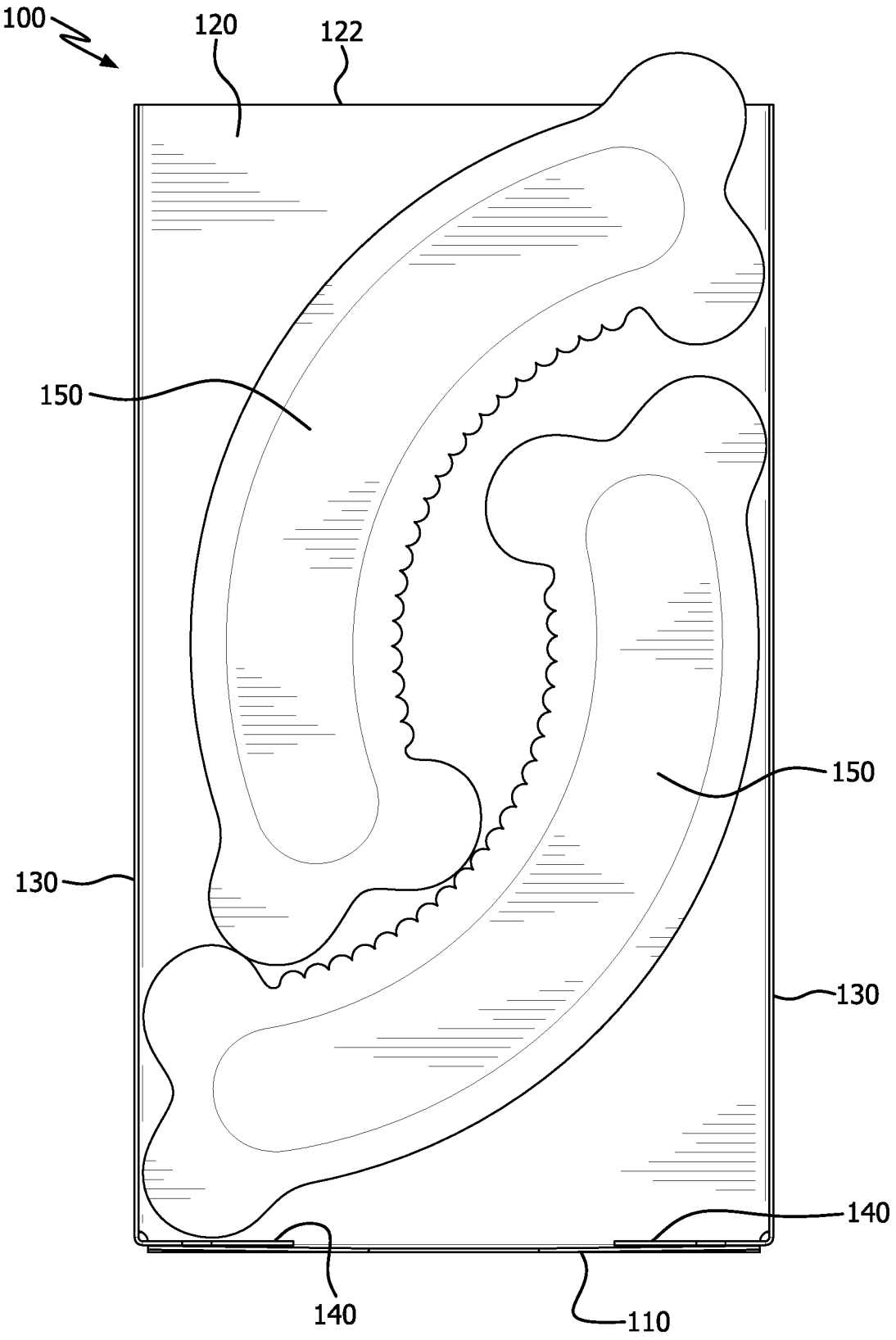
FIG. 8 shows a front view of two irregular-shaped products nested together and aligned in the carrier of FIG. 1.
Figure 9:
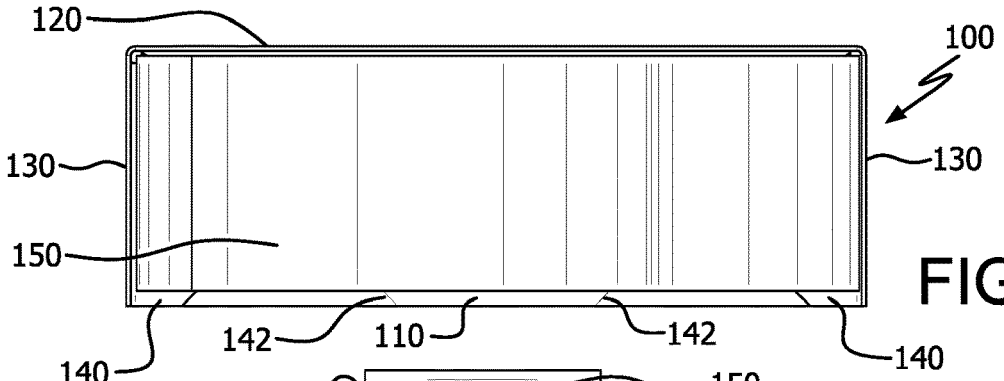
FIG. 9 shows a top view of two irregular-shaped products nested together and aligned in the carrier of FIG. 1.
Figure 10:
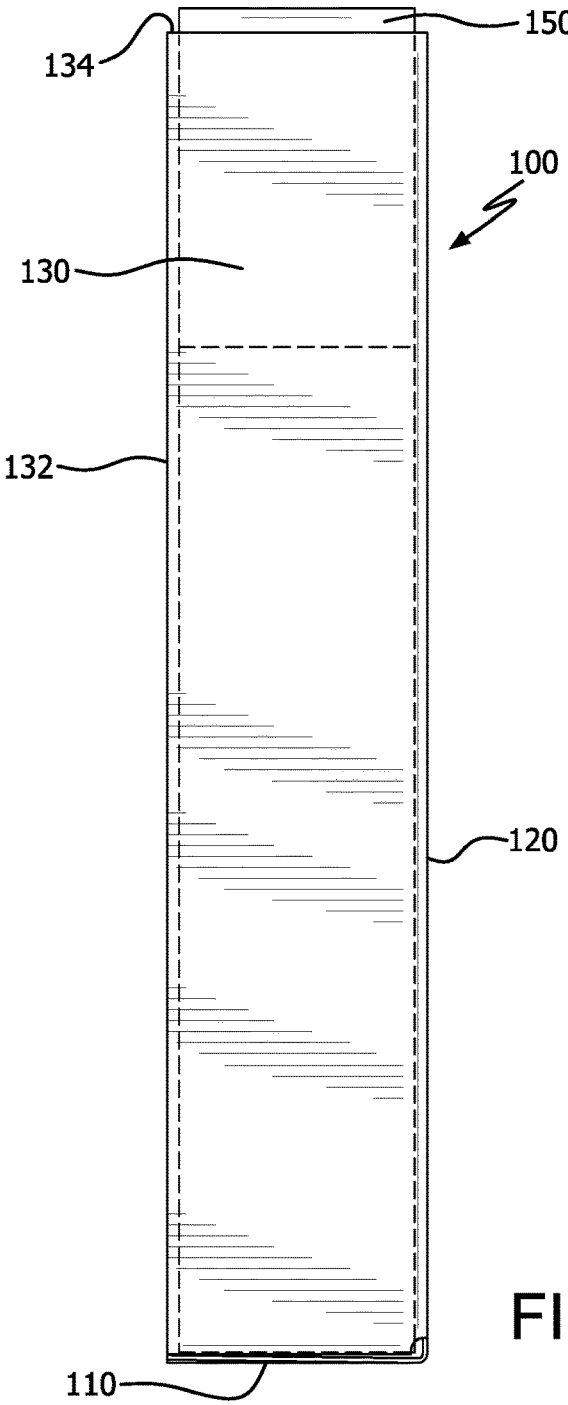
FIG. 10 shows a side view of two irregular-shaped products nested together and aligned in the carrier of FIG. 1.
Figure 11:
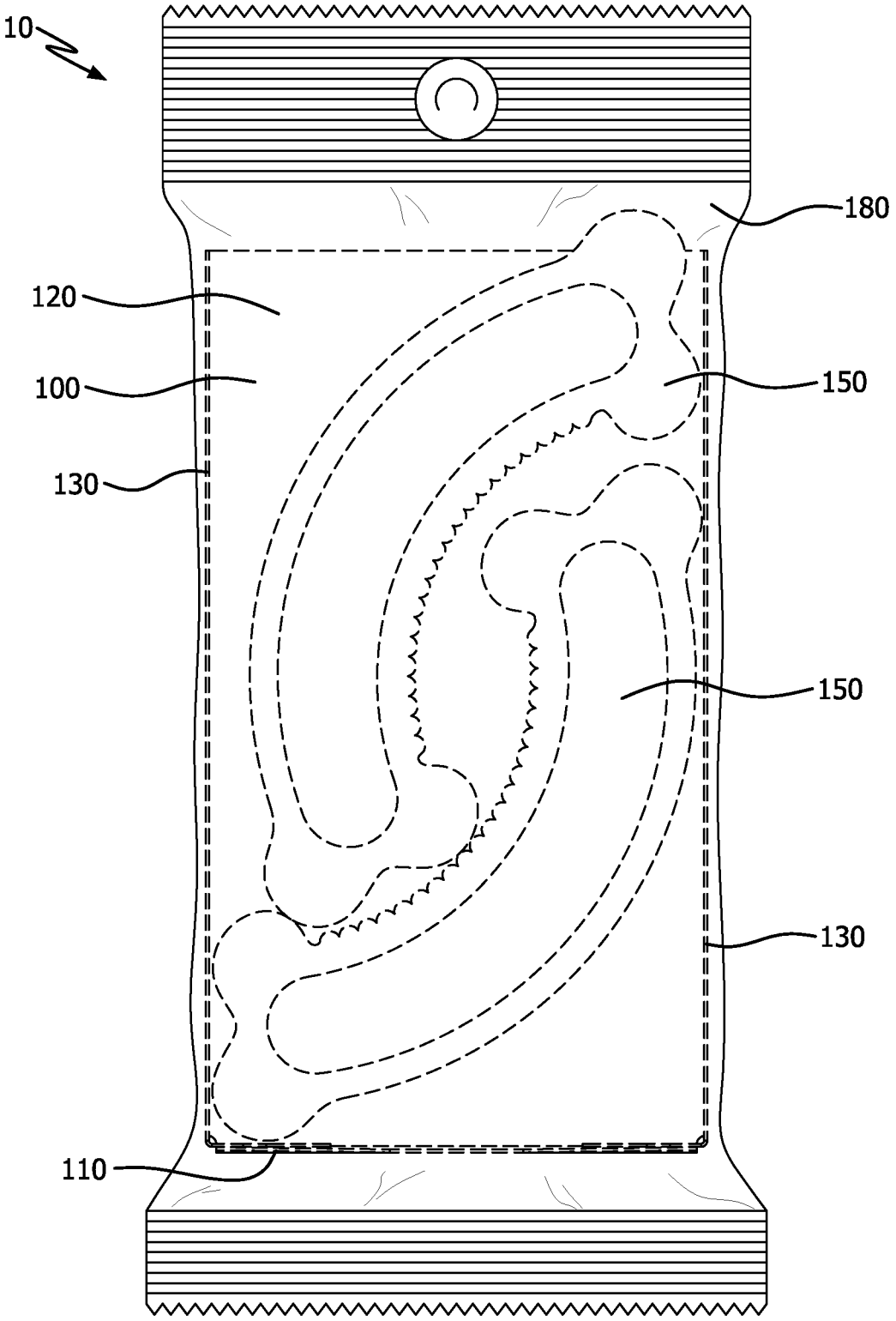
FIG. 11 shows a front view of two irregular-shaped products nested together and aligned in the carrier of FIG. 1, where the carrier and products are sealed with a wrap in a carrier package.

Referring to FIGS. 8 and 11, rear wall 120 and sidewalls 130, which are structurally supported by the corners formed with footing 110, provide a vertical support against which irregular-shaped product 150 can transfer lateral forces, i.e., lean, against, if carrier 100 and package 10 are placed upright. In the upright position, as illustrated in FIGS. 8 and 11, for example, a nested pair of irregular-shaped (e.g., curved) products 150 is shown, where each of the curved products has two ends, and where each end includes both a convexly-positioned nub and a concavely-positioned nub. FIGS. 8 and 11 illustrate that the convexly-positioned nub on one end of a first irregular-shaped product 150 rests on footing 110, while the concavely-positioned nub on the same end of the first irregular-shaped product 150 interlocks with and supports the convexly-positioned nub on an end of a second irregular-shaped product 150. Irregular-shaped products 150 can also lean against rear wall 120 and/or one or more of side walls 130. With irregular-shaped products 150 nested, at least 2 or more points of contact occur between irregular-shaped products 150 and the interior surface of carrier 100. These points of contact are on footing 110, rear wall 120, and side walls 130, as shown specifically in FIGS. 8 and 11, and align irregular-shaped products 150 in packing compartment of carrier 100.

Referring now to FIG. 11, enclosing at least one irregular-shaped product 150 in carrier 100 with wrap 180 further stabilizes the structure of carrier package 10 and secures product 150 in carrier 100. Wrap 180 is applied in a manner that permits carrier 100 to generally retain its 3-dimensional shape.

Figure 15:
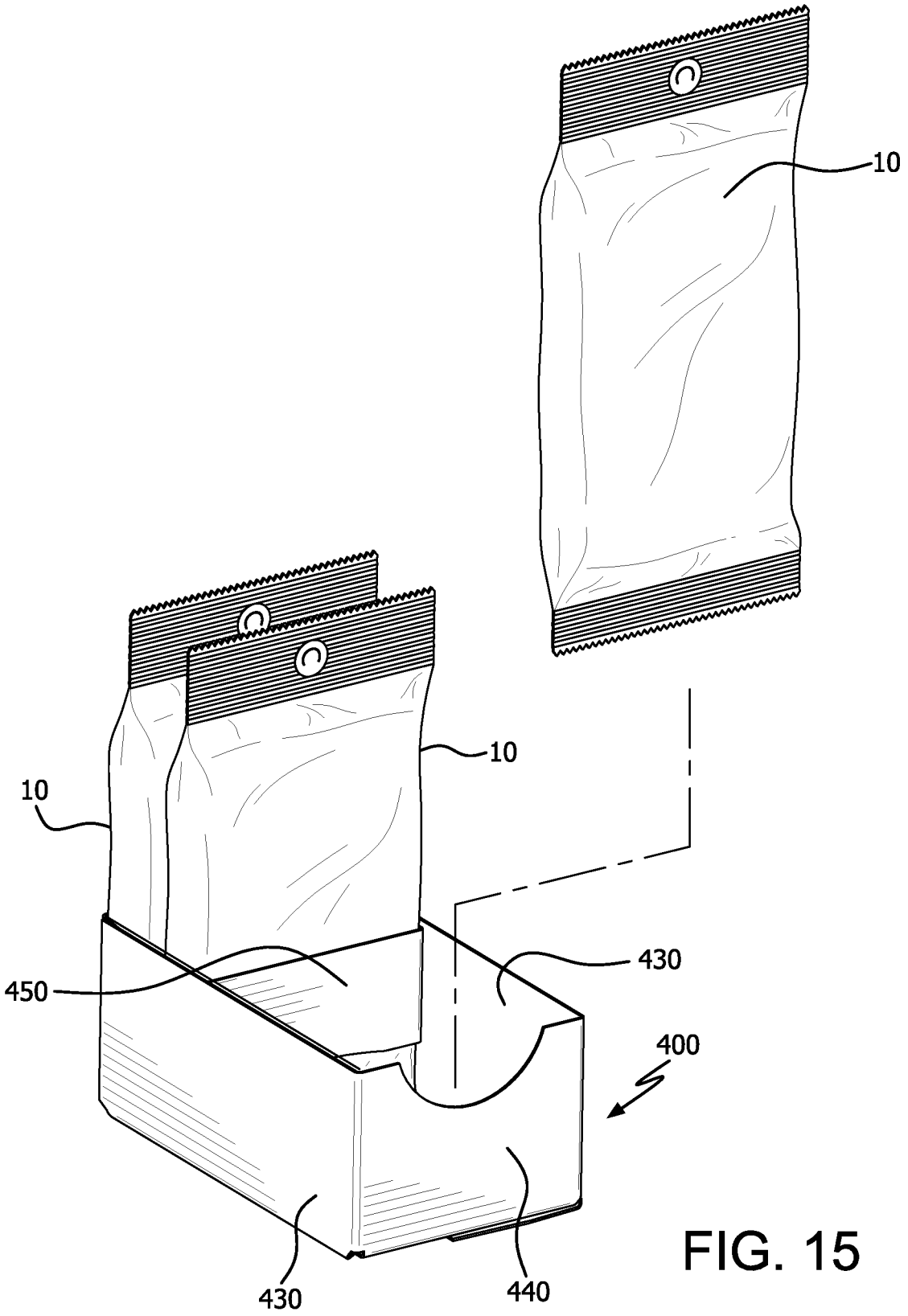
FIG. 15 shows a front perspective view of the display tray of FIG. 12 with two carrier packages placed therein.
Figure 16:
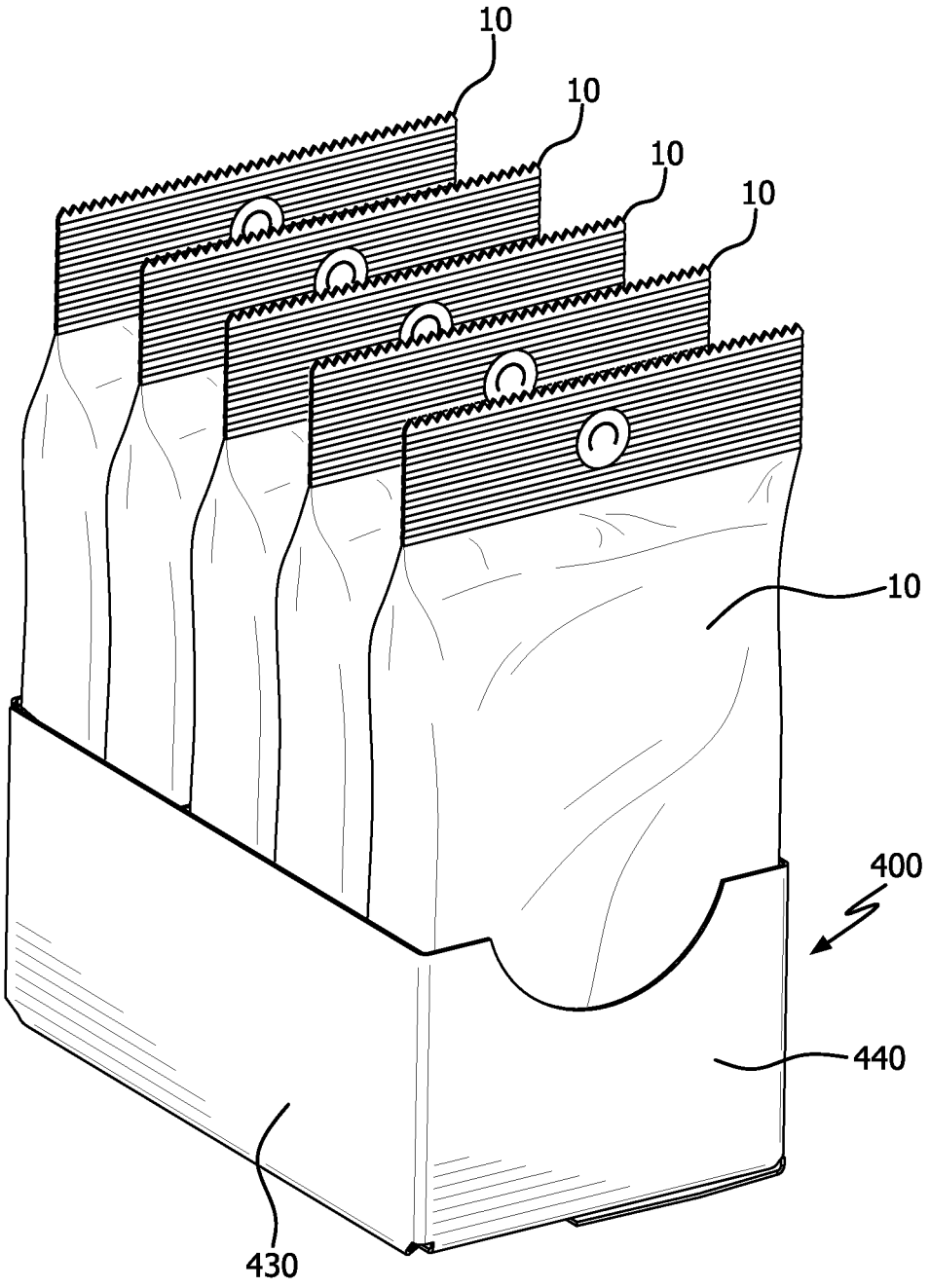
FIG. 16 shows a rear perspective view of the display tray of FIG. 12 filled with carrier packages.

In certain embodiments, carrier 100 is adapted to provide for efficient stacking and packing of irregular-shaped product 150 for logistical purposes. For example, carrier 100 can promote maximizing the number of products 150 that can be packed in a shipping container. Such efficient stacking is not only beneficial from a logistical perspective—it also provides retail benefits. Referring to FIGS. 15 and 16, for example, two to five carrier packages 10 in an upright and parallel configuration can be loaded in display tray 400 that can be placed on a shelf for display at a point of sale and that permits viewing of products 150 inside carrier package 10. Display tray 400 is sized and dimensioned relative to the size and dimension of carrier 100, 200.

Figure 17:
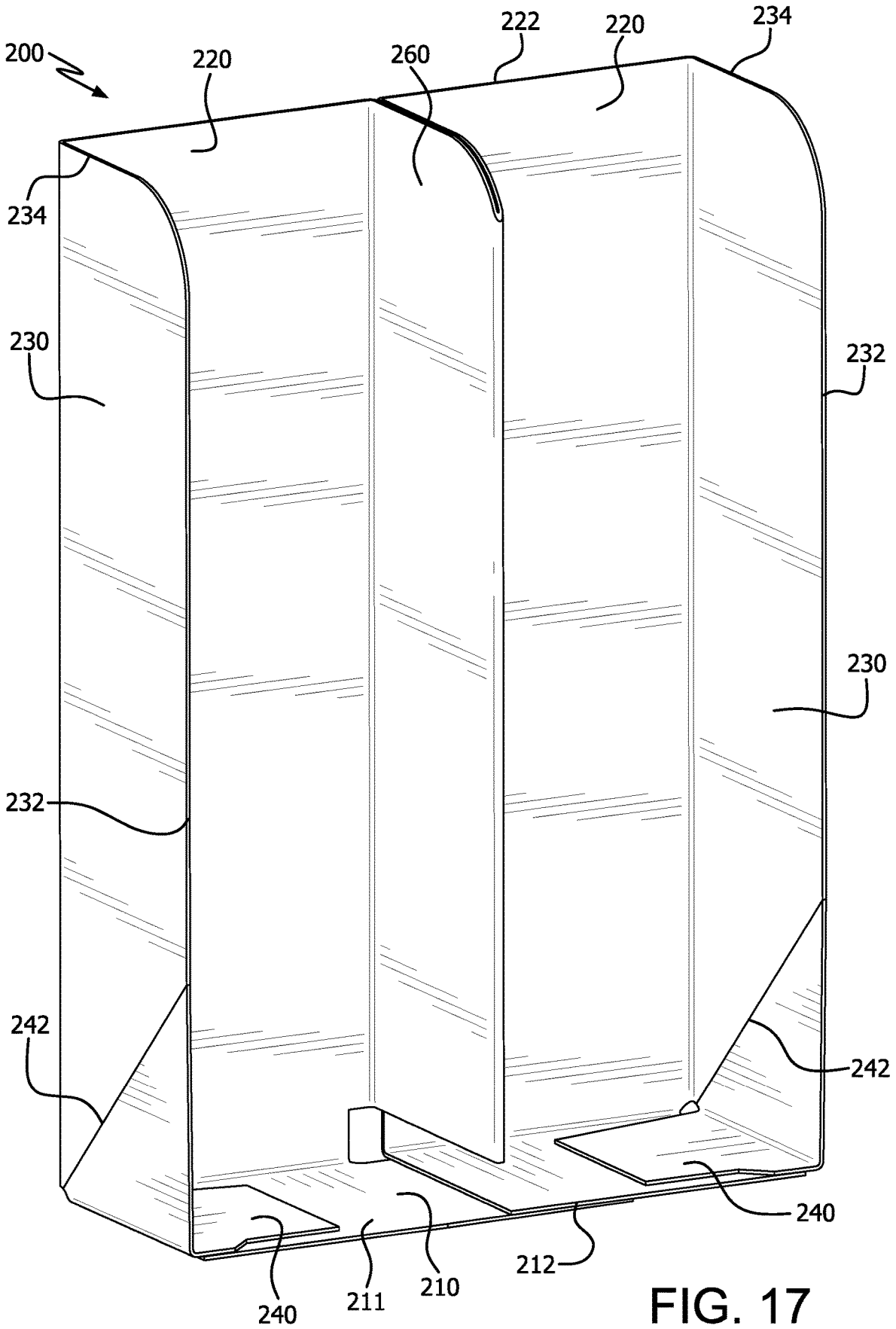
FIG. 17 shows a front perspective view of an alternative of a carrier having a divider for enclosing two irregular-shaped, consumable products.
Figure 18:
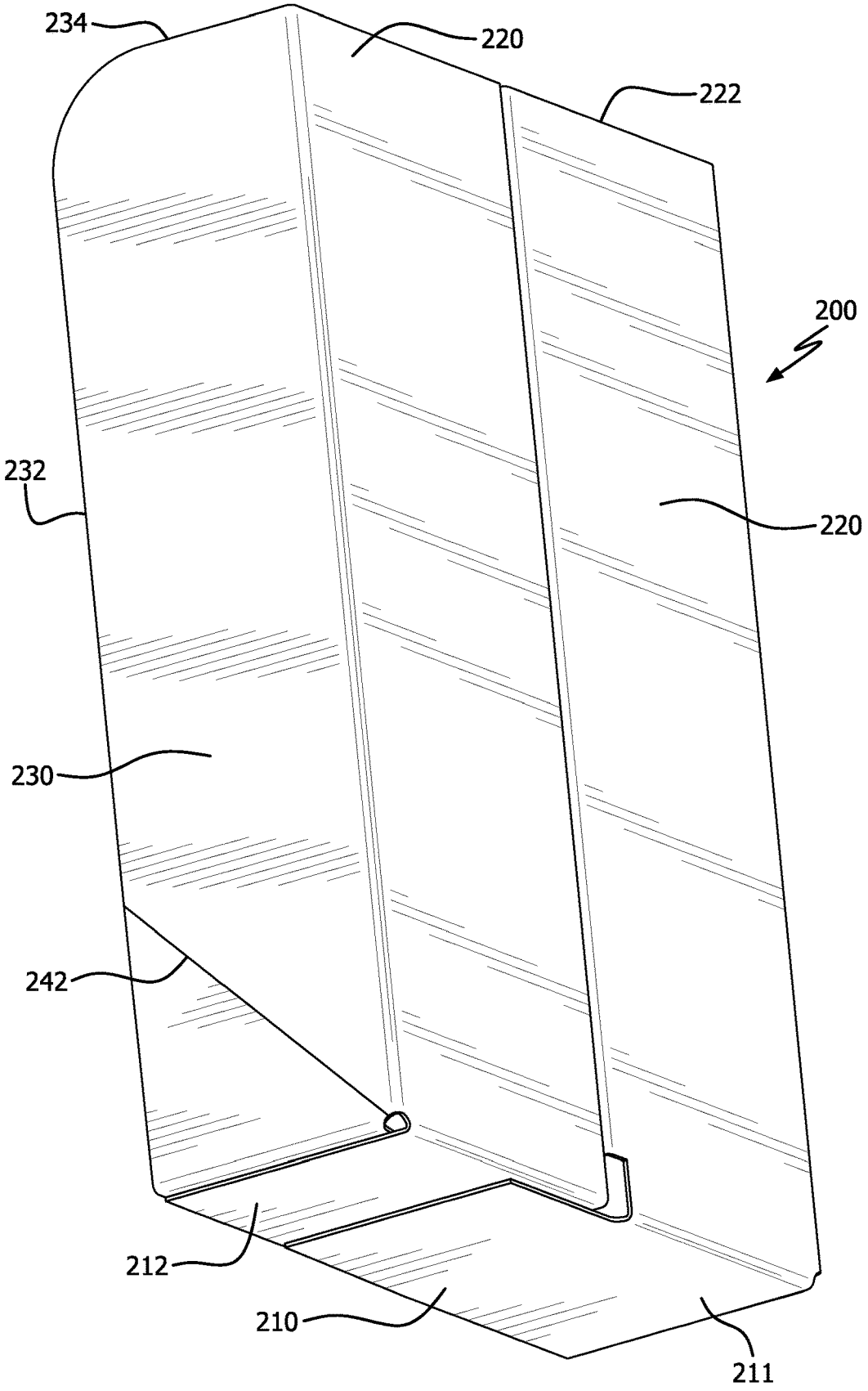
FIG. 18 shows a rear perspective view of the carrier of FIG. 17.

As discussed, carrier package 10 can include carrier 100 or carrier 200 shown, for example, in FIGS. 1 and 17. Carrier 100 includes packing compartment defined by footing 110 operatively connected to a vertical support member such as rear wall 120 and/or sidewall 130, wherein footing 110 and the vertical support member align and partially enclose at least one irregular-shaped product 150 in the packing compartment of carrier 100. Likewise, carrier 200 also includes packing compartments defined, in part, by footing 210 operatively connected to a vertical support member, such as rear wall 220 or sidewall 230, wherein footing 210 and vertical support member align and partially enclose irregular-shaped product 250 in the packing compartments of carrier 200. Such embodiments are adapted to enable carrier 100, 200 to maintain the upright parallel configuration with respect to every other carrier in display tray 400, even if display tray 400 is not fully loaded with carrier packages 10.

Figure 2:
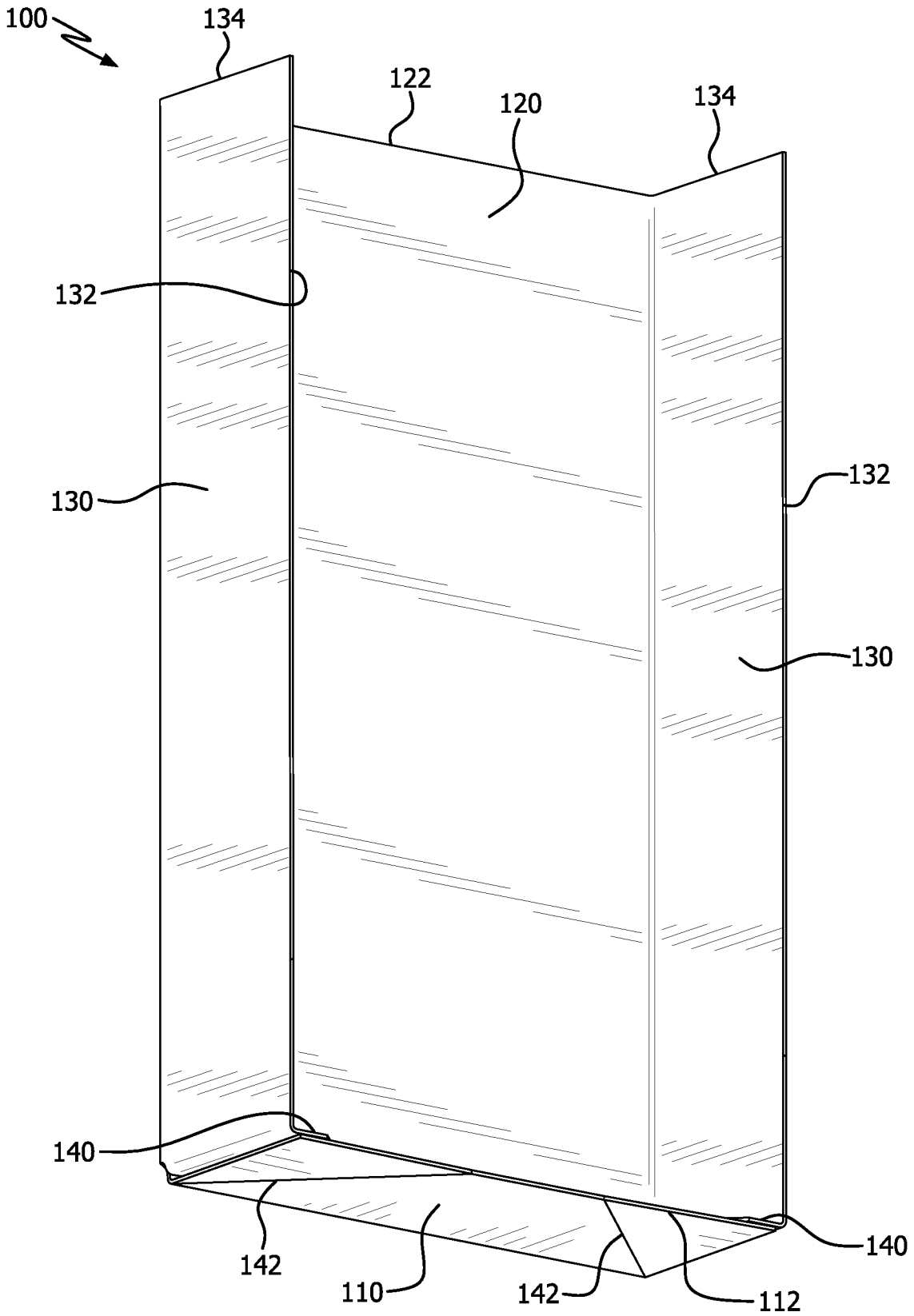
FIG. 2 shows another front perspective view of the carrier of FIG. 1.
Figure 3:
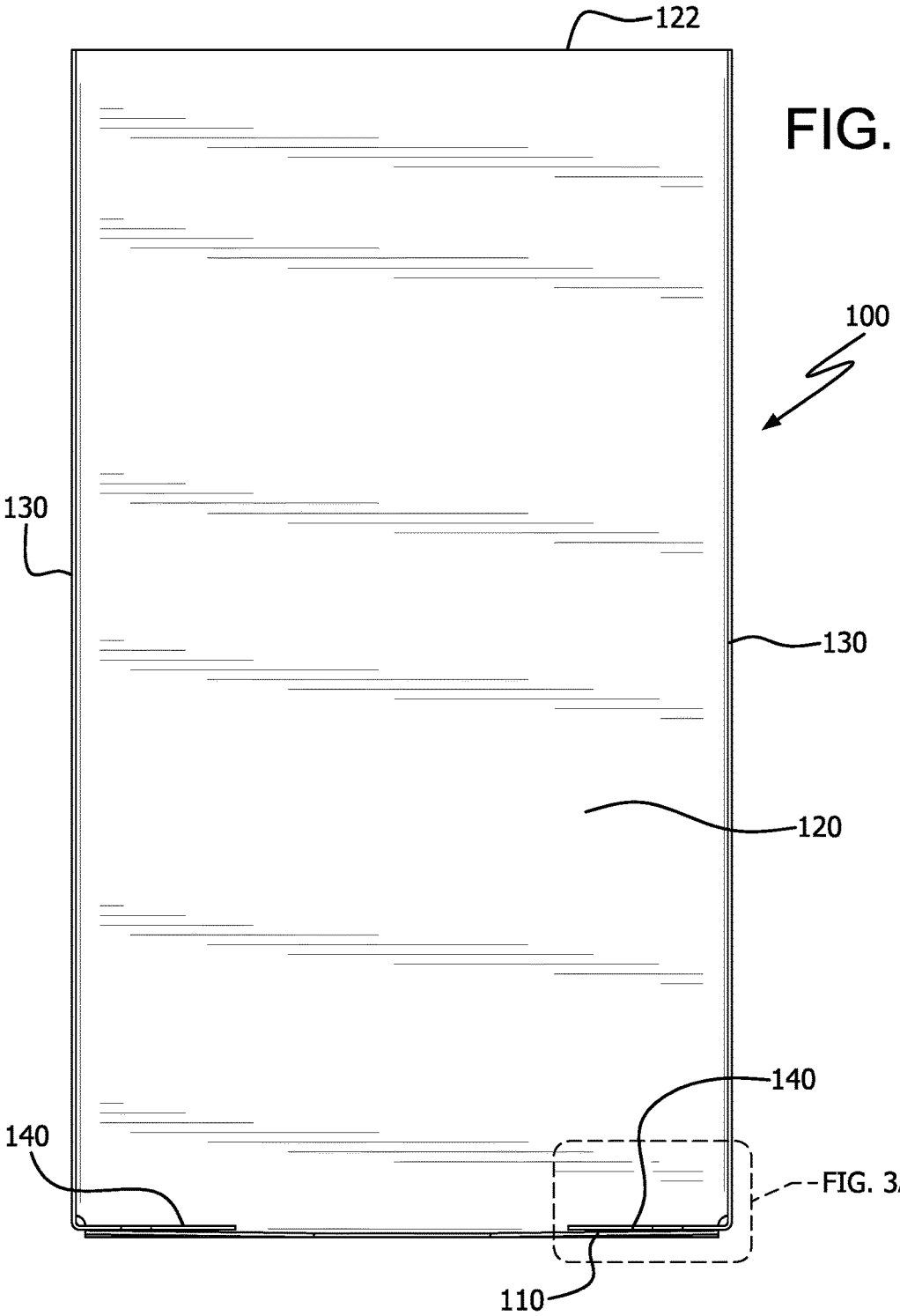
FIG. 3 shows a front view of the carrier of FIG. 1.
Figure 3A:
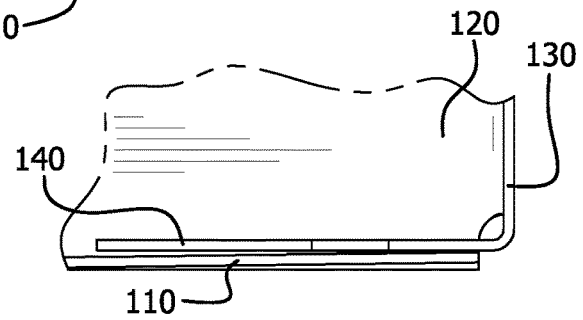
FIG. 3*a* shows a cutaway view of a portion of FIG. 3.
Figure 5:
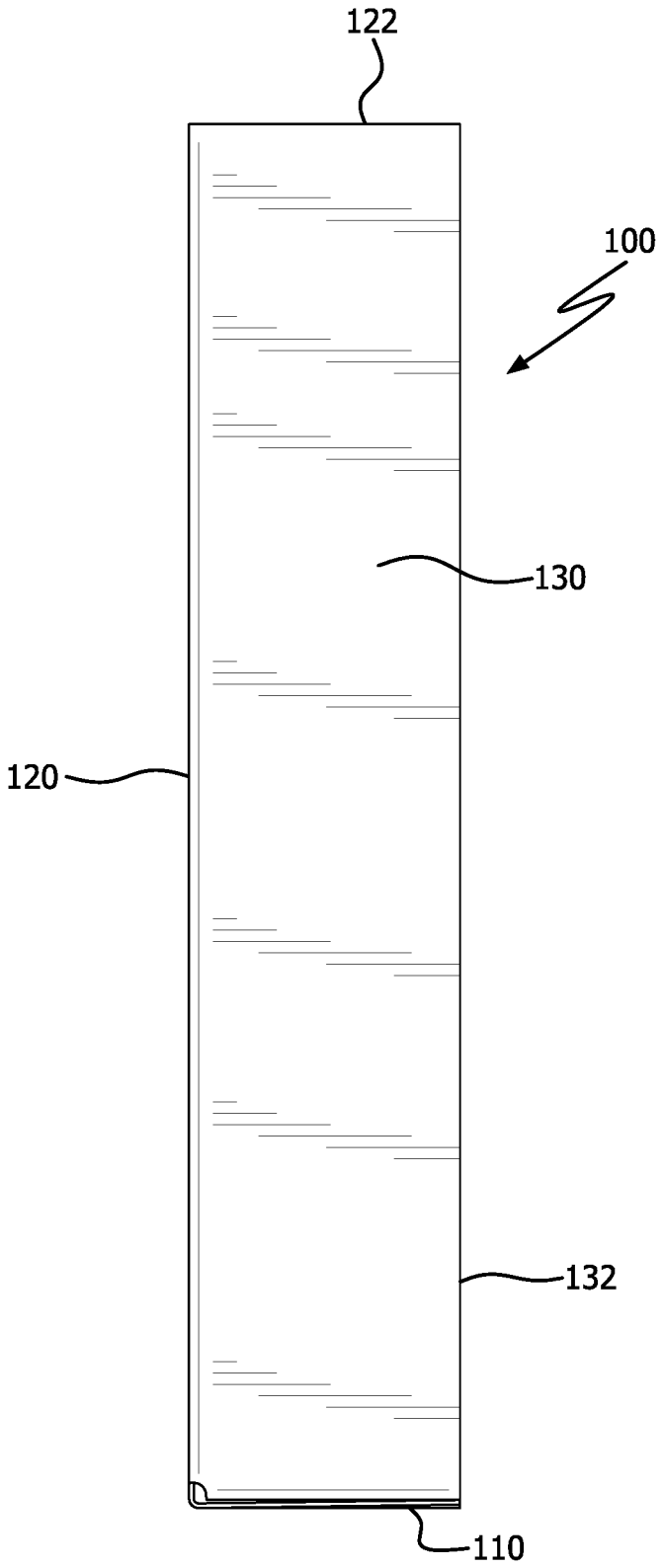
FIG. 5 shows a side view of the carrier of FIG. 1, whereby the opposite side view is a mirror image of FIG. 5.

Referring specifically to FIGS. 1-2, 3, and 6-7, footing 110 is rectangular and generally flat, but can be square or trapezoidal. Footing 110 is substantially perpendicular to rear wall 120, as shown in FIG. 5, and footing 110 is also substantially perpendicular to the side walls 130, as shown in FIGS. 3-3*a*. The depth of footing 110 is the distance from rear wall 120 to front edge 112 of footing 110, as shown specifically in FIGS. 1-2 and 6-7.

Figure 4:
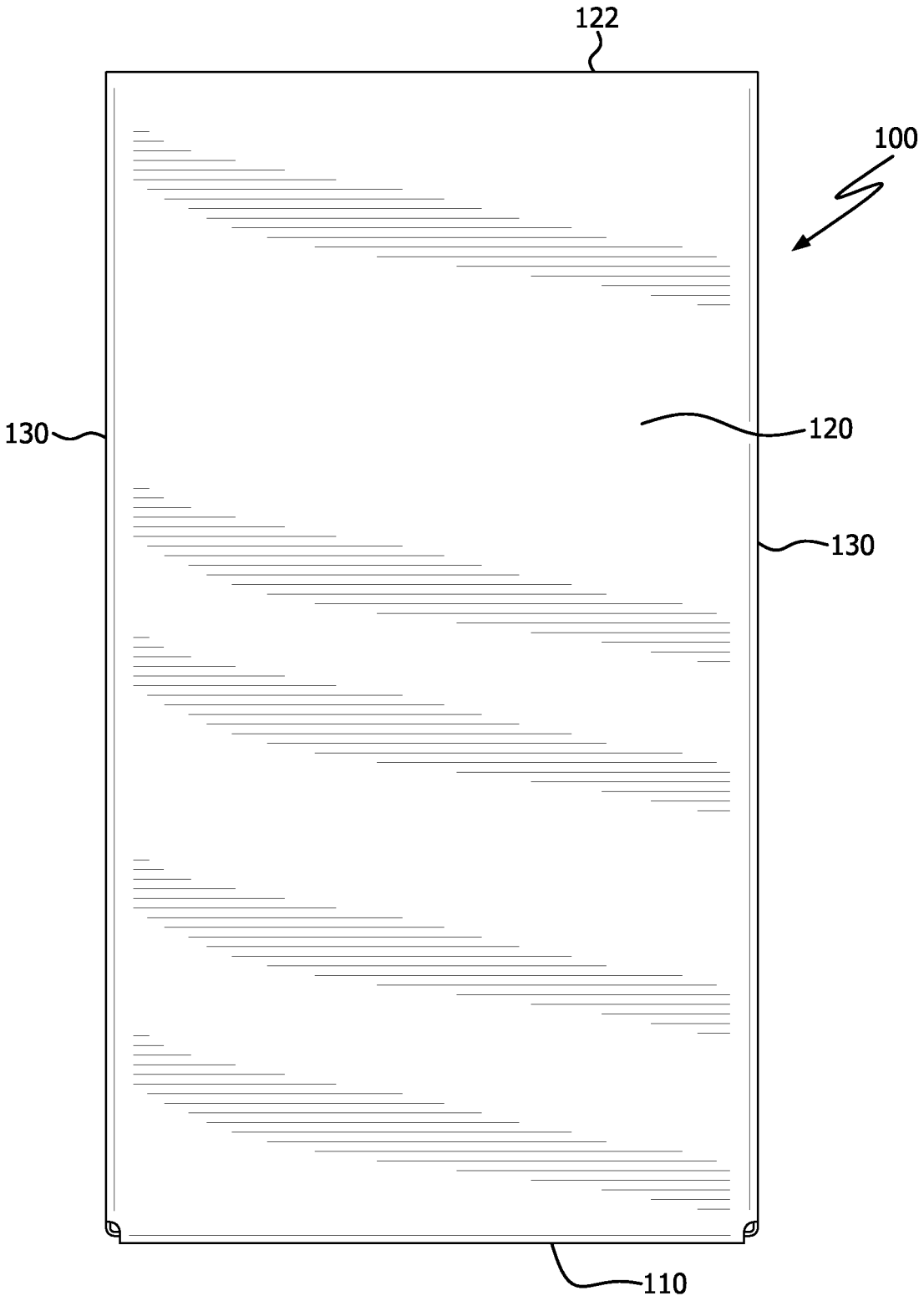
FIG. 4 shows a rear view of the carrier of FIG. 1.
Figure 6:
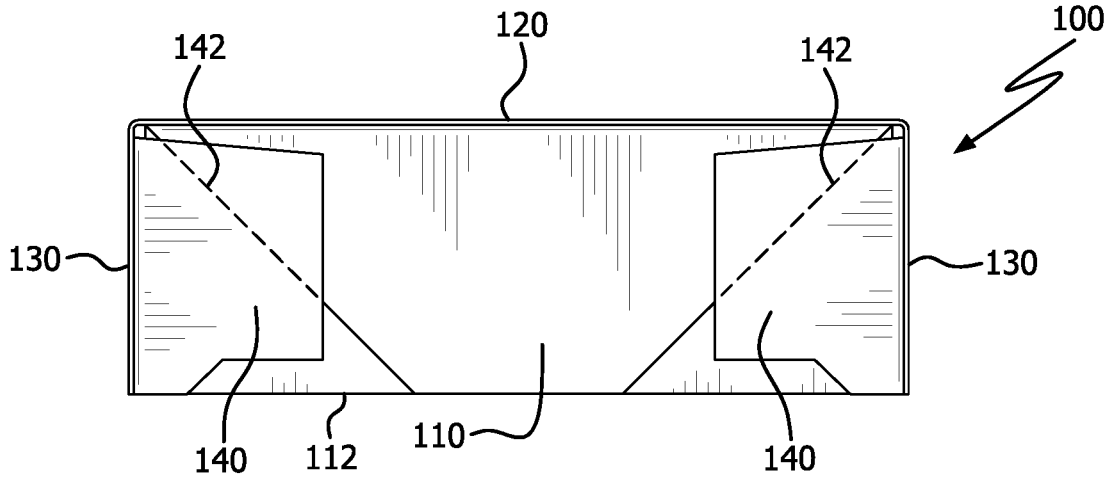
FIG. 6 shows a top view of the carrier of FIG. 1.
Figure 7:
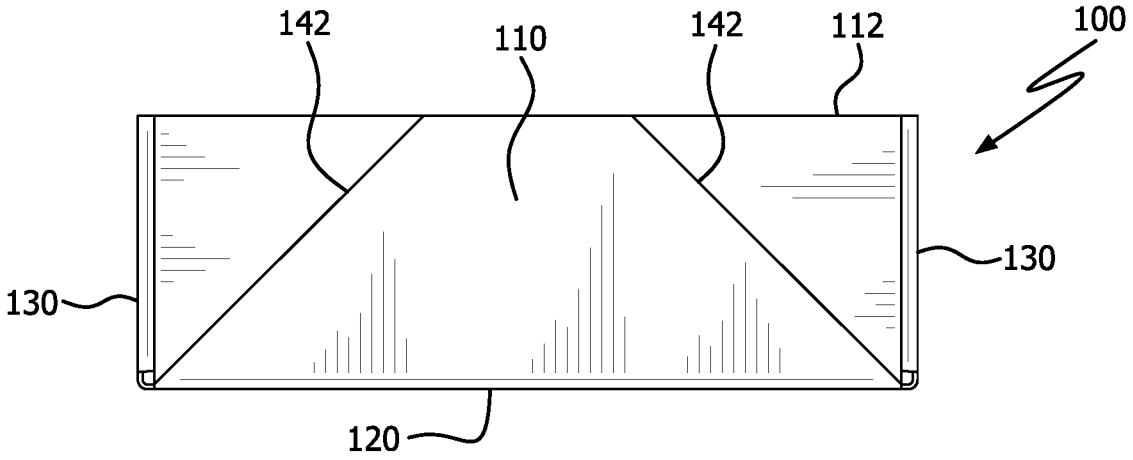
FIG. 7 shows a bottom view of the carrier of FIG. 1.

Referring now to FIGS. 3-5, rear wall 120 is rectangular and generally flat, but can be square or trapezoidal. Rear wall 120 is substantially perpendicular to sidewalls 130, as shown in FIG. 6, and to footing 110, as shown in FIG. 5. Opposite sides of rear wall 120 are either connected to or contiguous with the material of sidewalls 130, as shown, for example, in FIG. 6. The width of rear wall 120 is the distance between sidewalls 130, as also shown in FIG. 6. The height of rear wall 120 is the distance from footing 110 to top edge 122 of rear wall 120, as shown in FIGS. 1-5.

In certain embodiments, top edge 122 of rear wall 120 can be linear as shown in FIGS. 1-4, or curvilinear, between corners where top edge 122 intersects with sidewalls 130, depending upon design configuration of carrier 100, and particularly in view of the relative size of side walls 130.

Referring to FIG. 5, sidewalls 130 are rectangular in this embodiment, but can be square or trapezoidal. Sidewalls 130 are substantially perpendicular to rear wall 120, as shown in FIG. 6, and to footing 110, as shown in FIG. 3. Sidewalls 130 can either be connected by tabs 140, as shown in FIGS. 1-3*a* to, or be contiguous with, the material of rear wall 120. The depth of each sidewall 130 is the distance from front edge 132 of sidewall 130 to rear wall 120, as shown in FIGS. 1-2, and 5.

Referring to FIGS. 1 and 2, the height of sidewall 130 is the distance from footing 110 to top edge 134 of side wall 130. In various embodiments, the height of sidewall 130 is about equal to the height of rear wall 120, as shown, for example, in FIGS. 3 and 4. In other embodiments, the height of sidewalls 130 is greater than the height of rear wall 120. In still further embodiments, the height of sidewalls 130 is less than the height of rear wall 120. In even further embodiments, the height of a sidewall 130 is different than the height of an opposing sidewall 130, whereby top edge 122 of rear wall 120 can be curvilinear or linear so that top edge 122 terminates substantially adjacent to top edge 134 of each side wall 130.

In certain embodiments, top edge 134 of side wall 130 can be curved toward front edge 132. For example, top edge 134 can be curved at its corners, i.e., where it intersects with front edge 132. Conversely, top edge 134 can be curved along its entire width from its intersection with rear wall 120 and front edge 132.

Carrier 100 provides a packing compartment defined, in part, by the interior surfaces of footing 110, rear wall 120, and side walls 130. The packing compartment is configured relative to the dimensions of irregular-shaped product 150, for example, as depicted in FIG. 8. Specifically, the packing compartment is configured along its height, width, and depth to account for a substantially-minimal, 3-dimensional, symmetrical space, e.g., square, rectangular, trapezoidal, etc., in which one or more irregular-shaped products 150 can fit. For example, in an exemplary embodiment shown in FIG. 8, the packing compartment is configured to hold 2 irregular-shaped products 150, i.e., bent bone shape with two substantially flat surfaces, which are nested together to minimize the 3-dimensional size of the packing compartment. In this embodiment, the packing compartment is configured so that the depth of footing 110 and side walls 130 is either the same or greater than the depth of irregular-shaped products 150 placed in carrier 100. In alternative embodiments of carrier 100, the depth of footing 110 and side walls 130 can be equal to or less than the depth of products 150.

Referring again to FIG. 8, the packing compartment of carrier 100 has a height that is generally about the same height as two irregular-shaped products 150 nested together in the packing compartment. In this embodiment, the width of rear wall 120 and footing 110 contributes to the proximity and relative positioning of two irregular-shaped products 150 next to one another, as shown, for example, in FIG. 8. This embodiment shows that the height of rear wall 120 and side walls 130 is greater than the width of rear wall 120 and footing 110. In alternative embodiments of carrier 100, the width of the packing compartment can be more than its height.

Referring generally to FIG. 3, the ratio of the width of rear wall 120 to the height of sidewalls 130 is about 3:5. In other embodiments, the ratio of the width of rear wall to height of sidewall may be adjusted to provide for uniform alignment and secure packing of irregular-shaped products 150 in carrier 100 with minimal empty internal packing space.

Figure 19:
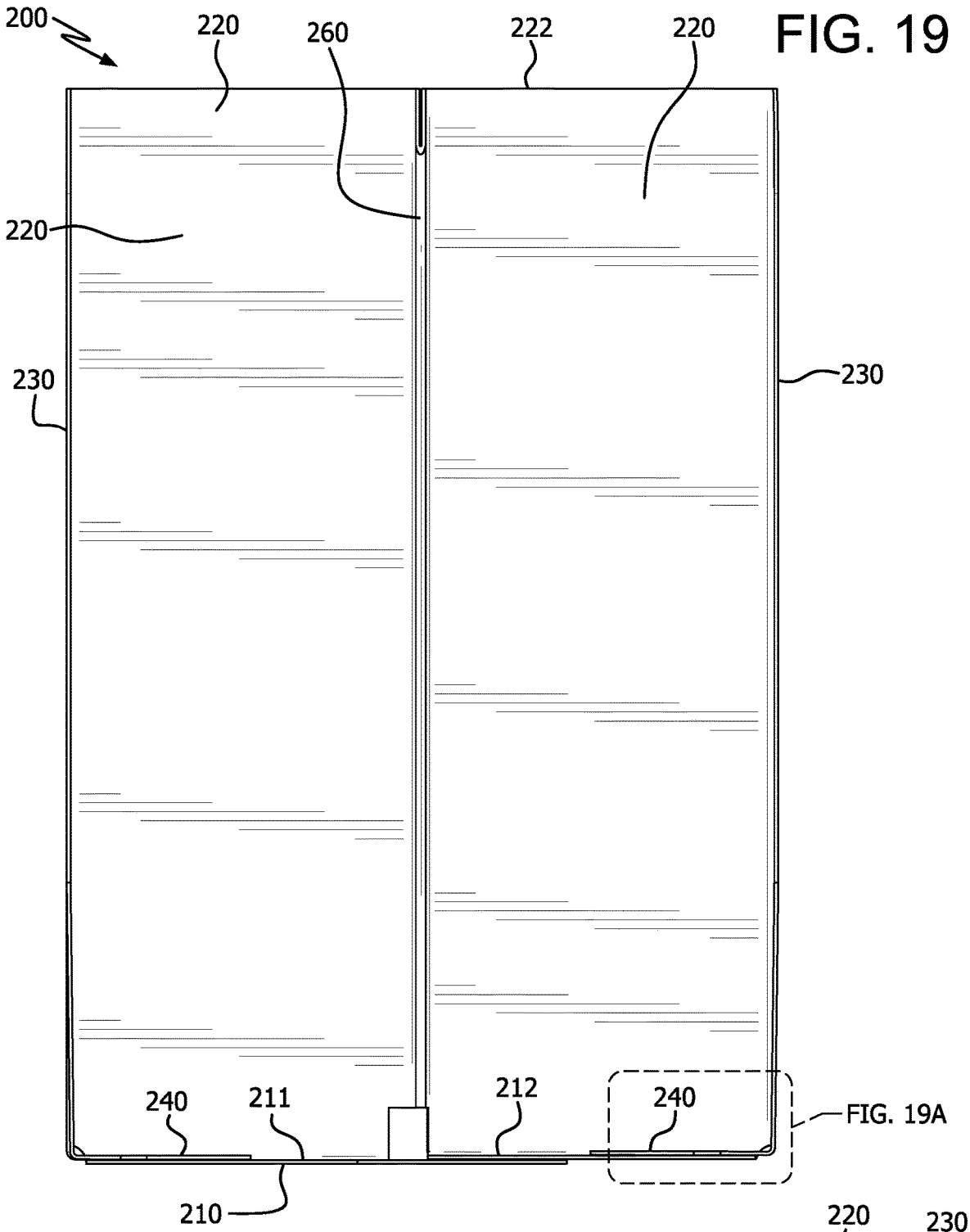
FIG. 19 shows a front view of the carrier of FIG. 17.
Figure 19A:
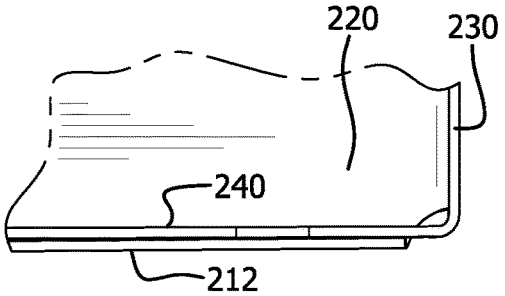
FIG. 19*a* shows a cutaway view of a portion of FIG. 19.
Figure 20:
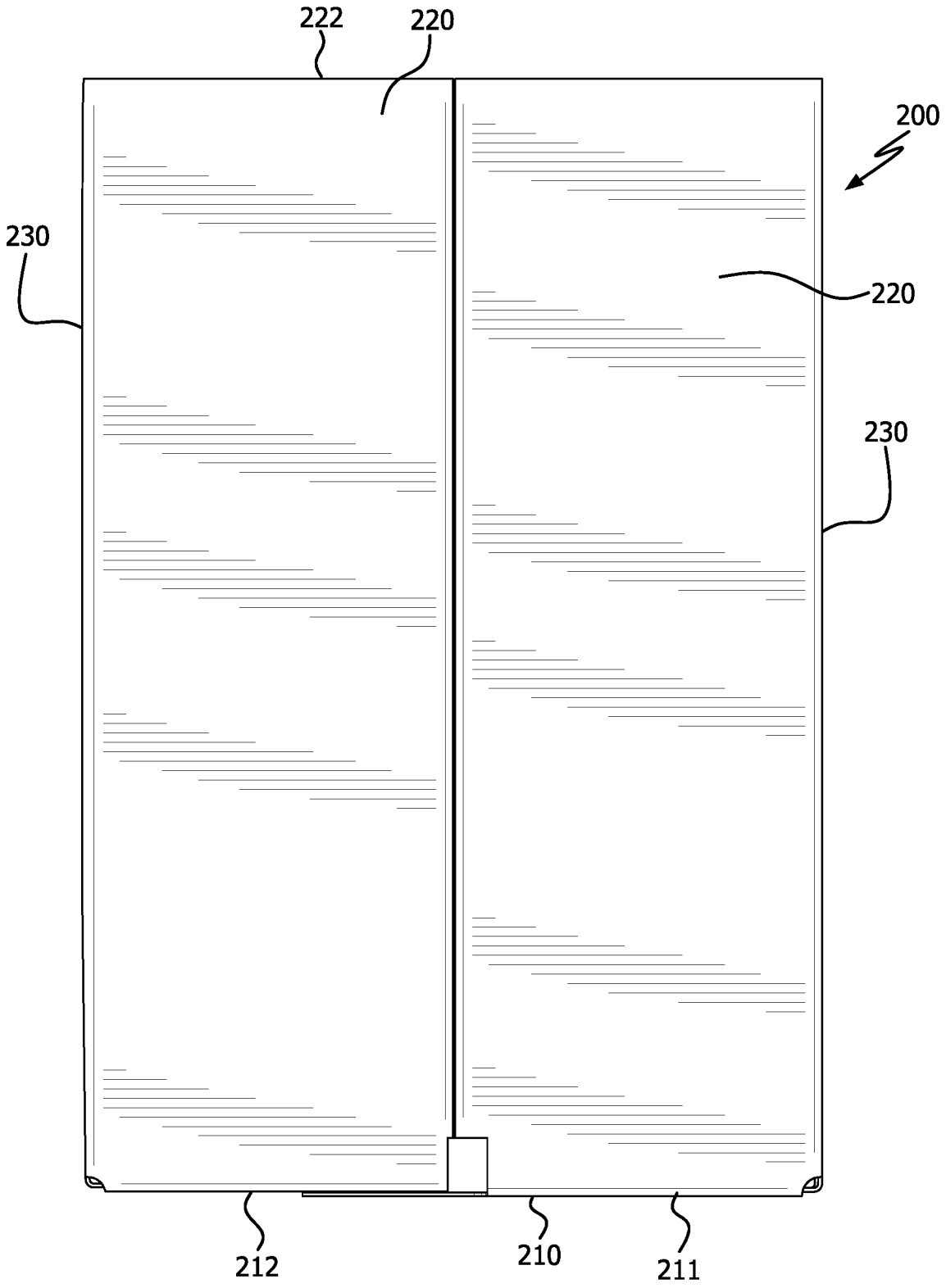
FIG. 20 shows a rear view of the carrier of FIG. 17.
Figure 21:
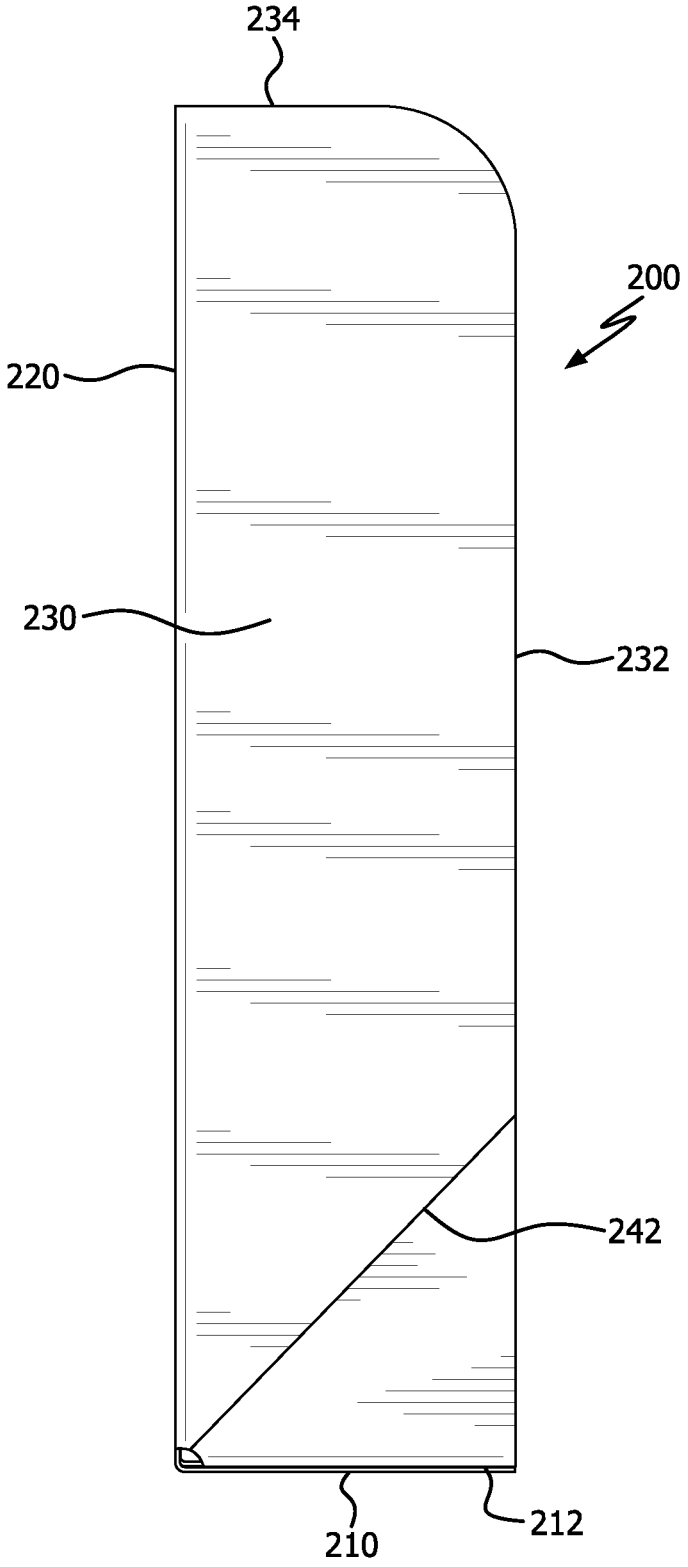
FIG. 21 shows a side view of the carrier of FIG. 17, whereby the opposite side view is a mirror image of FIG. 21.
Figure 22:
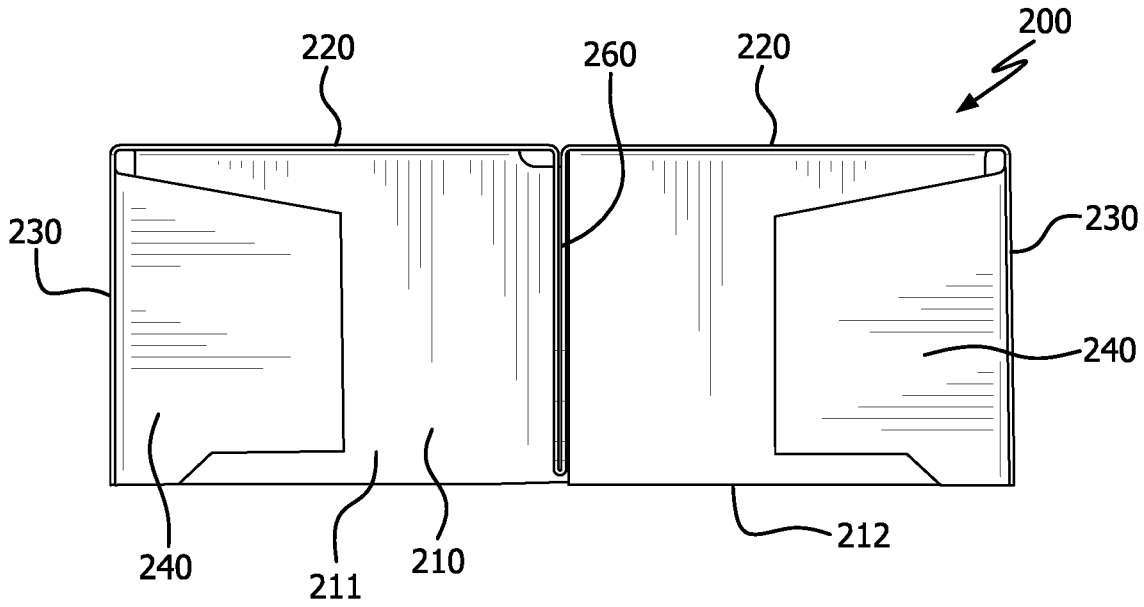
FIG. 22 shows a top view of the carrier of FIG. 17.
Figure 23:
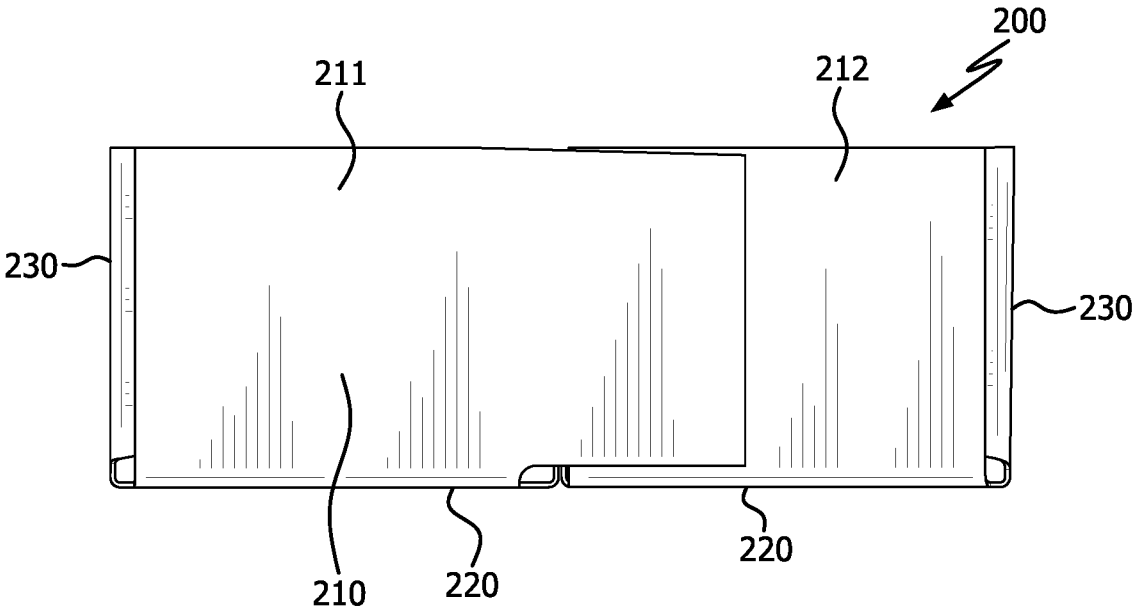
FIG. 23 shows a bottom view of the carrier of FIG. 17.
Figure 28:
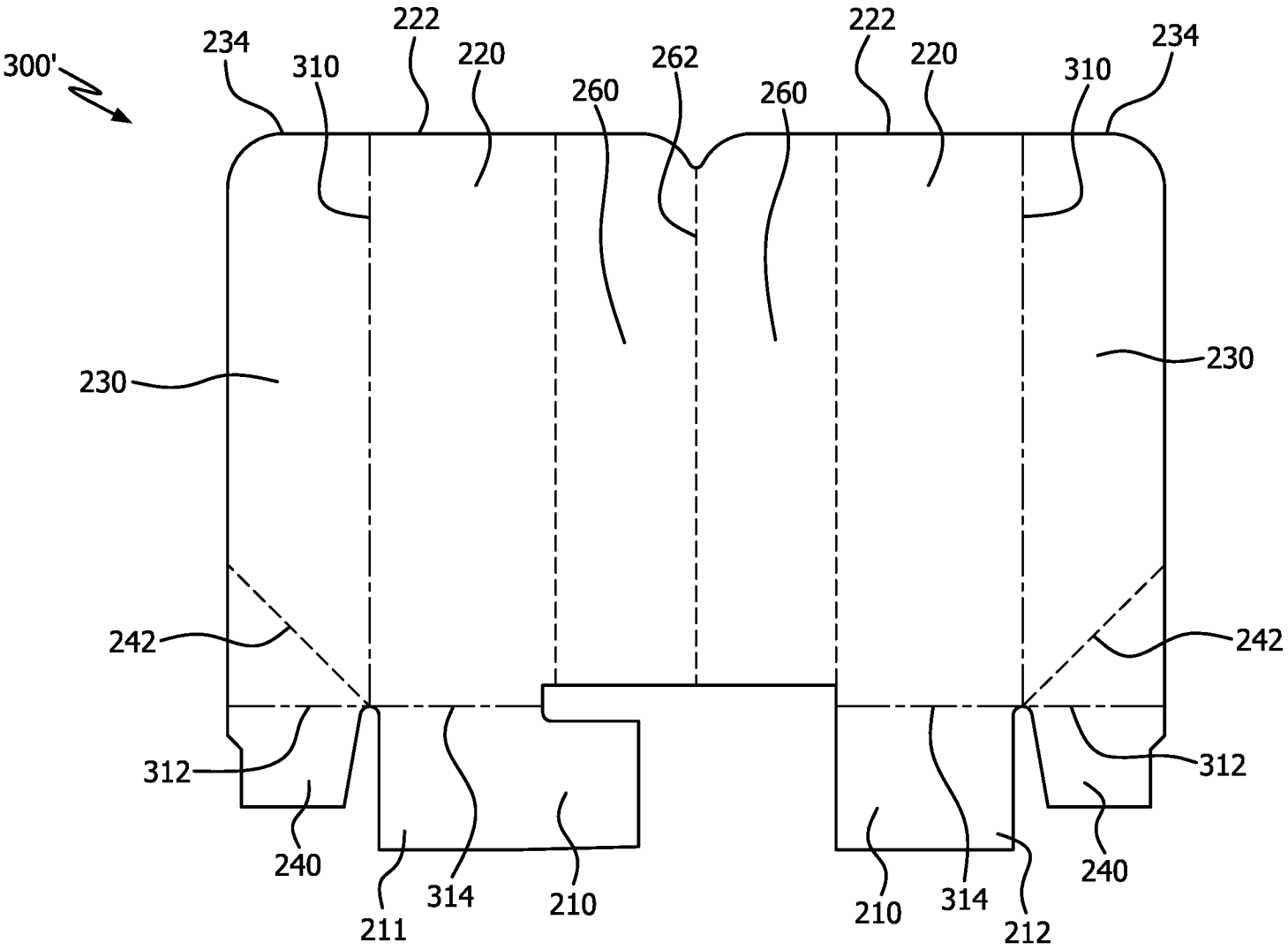
FIG. 28 shows a die-cut blank for the carrier of FIG. 17.

Referring generally now to FIGS. 17-26, an alternative embodiment of carrier 200 is shown. In this embodiment, rear wall 220 includes divider 260 that delineates two packing compartments, each of which is configured to house irregular-shaped products 250. Divider 260 can be configured to project outward from rear wall 220 substantially perpendicular to rear wall 220, as shown in FIG. 22, and substantially parallel with sidewalls 230, as shown in FIGS. 19 and 22. In some embodiments, divider 260 can have the same or similar height of rear wall 220, as shown in FIGS. 19, 21, and 24-25. In other embodiments, the height of divider 260 can be less than the height of rear wall 220. In still further embodiments, the height of divider 260 can be greater than the height of rear wall 220. The depth of divider 260 can be the same or similar depth of the side walls 230, as shown in FIG. 22. In an embodiment, divider 260 is located on substantially the centerline of the width of rear wall 220, as shown in FIGS. 19 and 22. Referring specifically to FIG. 28, divider 260 is formed by folding two adjacent portions of die-cut blank 300' onto themselves along central score line 262. In an embodiment, divider 260 is contiguous with the material forming rear wall 220.

Referring to FIGS. 17-18, 21, and 25, top edge 234 of sidewall 230 can also be curved. For example, top edge 234 can be curved at its front corners, i.e., where it intersects with front edge 232. Conversely, top edge 234 can be curved along its entire width from its intersection with top edge 222 of rear wall 220 to its intersection with front edge 232 of side wall 230.

In a non-limiting embodiment shown in FIGS. 17, 19, **19*a*, 22 and 24, tabs 240 are provided at ends of opposite sidewalls 230 so that tabs 240 can be glued (or structurally attached) to either the top (or bottom) surface of footing 210, wherein footing 210 comprises sub-footing 211 and sub-footing 212. This operatively connects opposite sidewalls 230 with footing 210 and rear wall 220 and forms corners at the lower, rear of carrier 200 that provide structural stability to carrier package 10. The bottom of a portion of sub-footing 212 can be affixed to the top of a portion of sub-footing 211, as shown, for example, in FIGS. 17-20. Alternatively, the bottom of a portion of sub-footing 211 can be affixed to the top of a portion of sub-footing 212. In certain embodiments, footing 210 and tabs 240 can have scoring or fold lines 242, as shown in FIGS. 17-18, 21, and 25, which allows divider 260 to be folded to the side, and footing 210 and tabs 240 to be folded inward against rear wall 220 to collapse carrier 200 for storage for use later in assembling carrier package 10. This configuration allows for efficient fabrication of carrier 200**, and easy opening on commercial packing lines, e.g., flow wrap systems, for efficient product loading.

Figure 24:
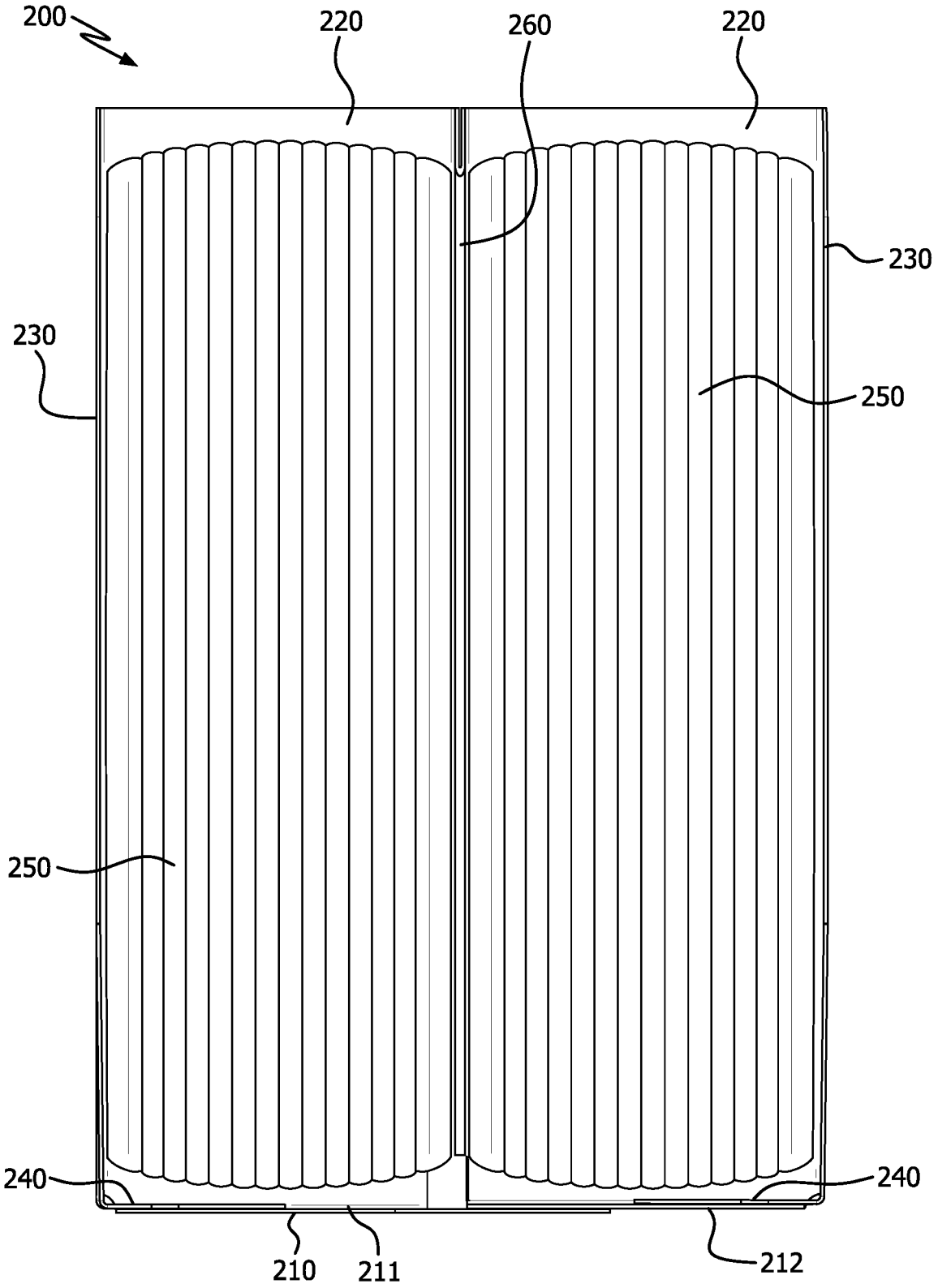
FIG. 24 shows a front view of two irregular-shaped products aligned in the carrier of FIG. 17.
Figure 25:
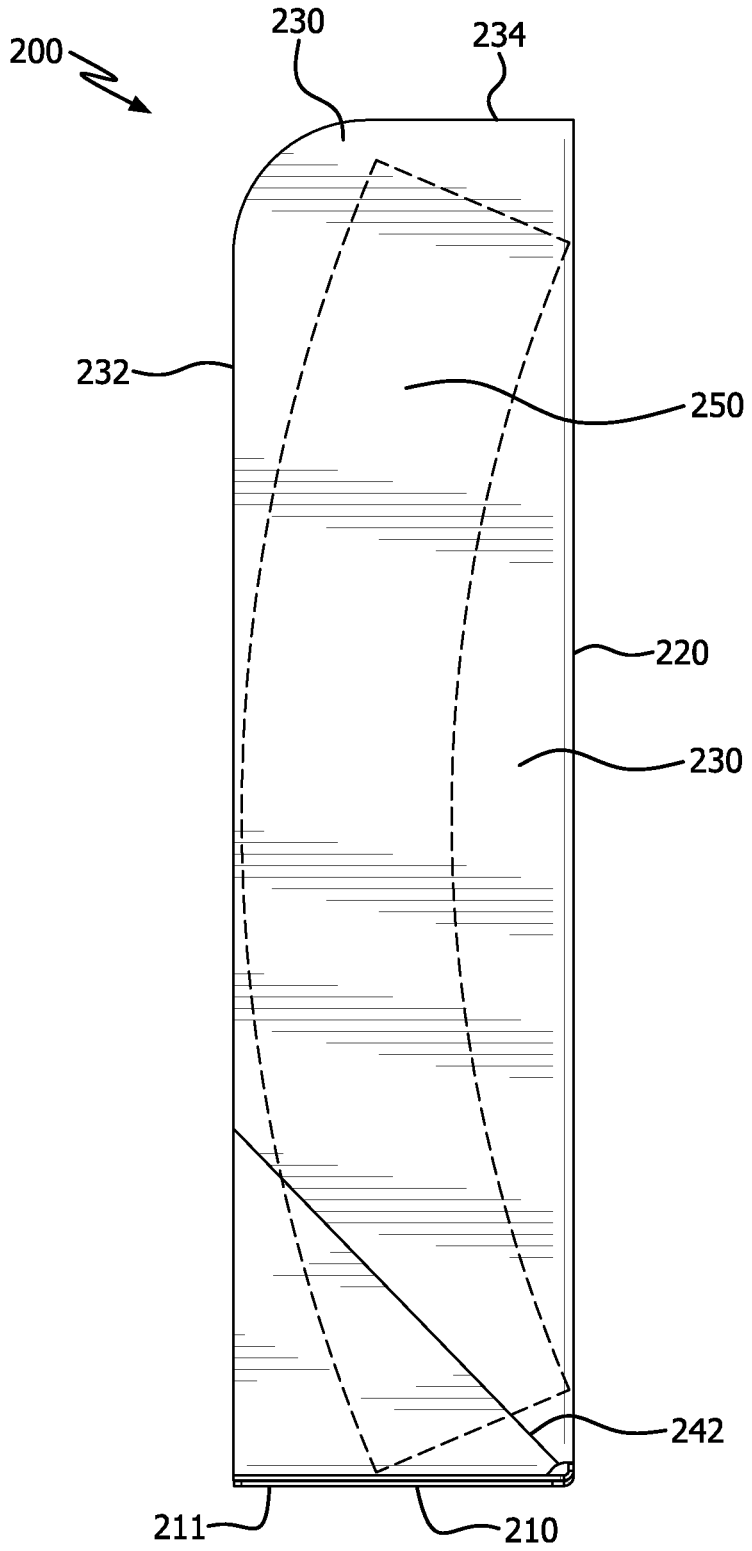
FIG. 25 shows a side view of two irregular-shaped products aligned in the carrier of FIG. 17.
Figure 26:
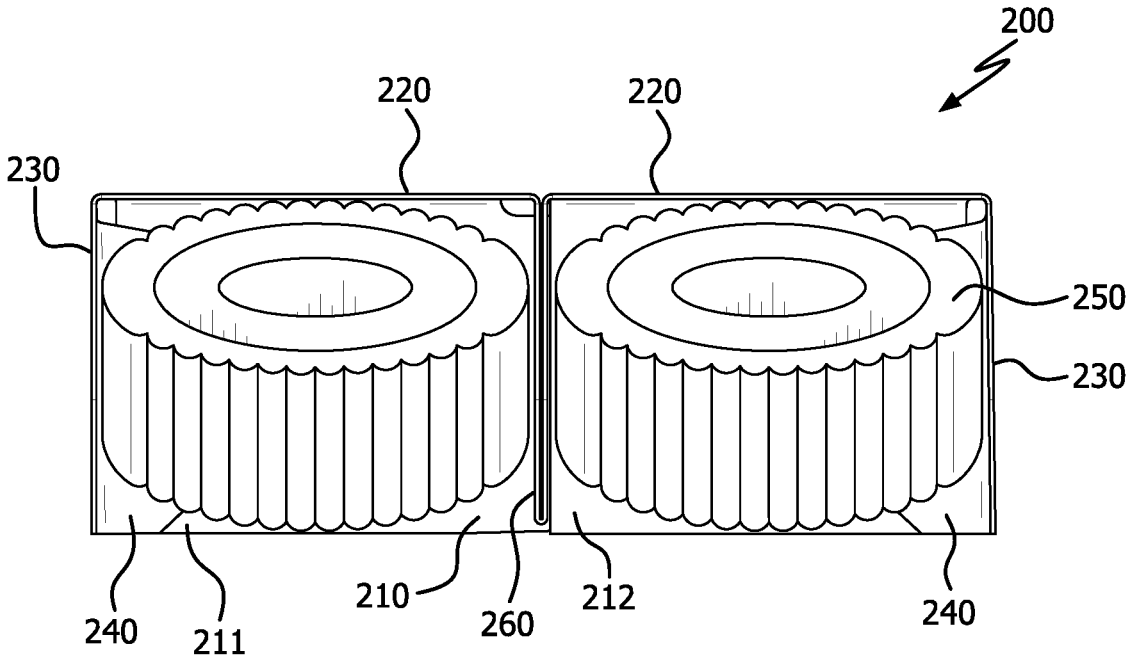
FIG. 26 shows a top view of two irregular-shaped products aligned in the carrier of FIG. 17.

Referring now to FIGS. 17, 19, 20, 22, and 24, carrier 200 provides packing compartments defined, in part, by the interior surfaces of footing 210, rear wall 220, side walls 230, and divider 260. The packing compartments are configured relative to the dimensions of irregular-shaped product 250, as shown specifically in FIGS. 24-25. The packing compartments are configured along their height, width, and depth, to account for a substantially minimal 3-dimensional symmetrical space, e.g., square, rectangular, trapezoidal, etc., in which one or more irregular-shaped products 250 can fit. For example, in an exemplary embodiment shown in FIG. 24, each packing compartment is configured to hold one irregular-shaped product 250, i.e., bent bone shape, which is aligned within a single packing compartment. In this embodiment, the packing compartment is configured so that the depth of footing 210 and side walls 230 is either the same or greater than the depth of irregular-shaped products 250 placed in carrier 200. In alternative embodiments of carrier 200, the depth of footing 210 and side walls 230 can be equal to or more than the depth of irregular-shaped products 250, as shown in FIGS. 24 and 25.

Referring again to FIGS. 24 and 25, the packing compartments of carrier 200 have a height that is about the same height as irregular-shaped product 250. In this embodiment, the distance between sidewall 230 and divider 260 contributes to the proximity and relative positioning of two irregular-shaped products 250 next to one another. This embodiment shows that the height of rear wall 220 and side walls 230 is greater than the width of rear wall 220 and footing 210. In alternative embodiments of carrier 200, the width of rear wall 220 and footing 210 can be more than its height.

Referring now to FIG. 11, wrap 180 can be made from a plastic material that can be transparent and can include a colorant or pigment. Other materials can be used for wrap 180 including foils, foil-lined plastics, foil-lined paper-based material, and the like. Suitable materials for wrap 180 can have a desired barrier property for moisture and air that can optionally be used to hermetically seal carrier 100, 200, thereby securing one or more irregular-shaped products 150, 250 to prevent premature spoilage of products 150, 250 after packing with carrier 100, 200. In certain embodiments, suitable plastic material for wrap 180 includes high density polyethylene (HDPE), polypropylene, polystyrene, polyvinylchloride, fluorinated ethylene propylene, acrylonitrile copolymer, polycarbonate, polytetrafluoroethylene (PFTE), cyclic olefin copolymer, polyethylene terephthalate (PET), and the like.

In certain embodiments, wrap 180 can be sealed around carrier 100, 200, securing one or more irregular-shaped products 150, 250 using commercial methods including, for example, heat, mechanical force, or adhesives that can be thermosetting, or some combination of the foregoing.

Referring to FIGS. 8-11 and 24-26, irregular-shaped product 150, 250 includes food products. In certain embodiments, the food products may be pet food products or human food products. The irregular-shaped product can be bone shaped.

Referring generally to FIGS. 12-16, display tray 400 is provided for holding multiple carrier packages 10 that are packed into retail-ready or shelf-ready packaging, useful for both product promotions and positioning at point-of-sale displays. Display tray 400 provides technology for uniformly aligning and securely packing irregular-shaped products 150, 250 in carrier packages 10 and displaying them for sale. Footing 100, 200 of each carrier 100, 200 enables each carrier package 10 loaded in display tray 400 to maintain an upright, parallel configuration relative to other carrier packages 10 loaded in display tray 400. Specifically referring to FIG. 12-14, container 400 comprises base 410 that is either connected to or contiguous with the material forming two opposite sidewalls 430, rear wall 420, and front wall 440. Sidewalls 430 further connect rear wall 420 and front wall 440. Retention arm 450 is connected to both sidewalls 430 at a distance between rear wall 420 and front wall 440.

Referring generally to FIGS. 15-16, multiple carrier packages 10 are shown packed into a retail-ready or shelf-ready display tray 400. More specifically, the display tray 400 shown contains from about 2 to 5 carrier packages 10. Although not show in the figures, each carrier package comprises a packing compartment defined by a footing operatively connected to a vertical support member. The vertical support member itself is comprised of a rear wall and/or one or more sidewalls. The footing and a vertical support member align and partially enclose at least one irregular-shaped consumable product in the packing compartment of each carrier. In this arrangement, where each carrier package in the display tray 400 is oriented upright and inserted footing first into the display tray so that its footing is completely contained within the tray and adjacent to the tray base 410, the footing associated with each carrier package 10 imparts vertical stability, enabling each carrier package to maintain an upright and parallel configuration with respect to every other carrier in the display tray. The upright and parallel configuration results in carrier packages that are uniformly aligned and securely packaged within the display tray. This is beneficial in a retail setting because it affects the appearance of the display, specifically increasing the overall neatness of the display which also increases the consumer's perception of product quality.

The parallel configuration a carrier package has relative to another carrier package in the display tray is measured as an angle formed between neighboring sidewalls of two adjacent carrier packages. This angle is determined by choosing one side of a filled tray containing carrier packages that are standing upright, drawing a line tangent to the sidewall of a first carrier package held within the tray, drawing another line tangent to the sidewall of a second carrier package held within the tray that is adjacent to the first carrier package, projecting these tangential lines onto a 2-dimensional plane, and then measuring the angle formed between the two lines. In certain embodiments the angle formed between neighboring sidewalls of two adjacent carrier packages is from about 0° to about 20°, preferably from about 0° to about 10°, more preferably from about 0° to about 5°, even more preferably from 0° to about 2°, and even more preferably from about 0° to about 1°. In certain embodiments the angle formed between neighboring sidewalls of two adjacent carrier packages is less than about 20°, preferably is less than about 10°, more preferably is less than about 5°, even more preferably is less than about 2°, and even more preferably is less than about 1°.

Referring generally to FIG. 15, retention arm 450 is adapted to further secure several carrier packages 10 upright in display tray 400, even if display tray 400 is not fully loaded with carrier packages 10. In certain embodiments, the ratio of the distance between (i) retention arm 450 and rear wall 420, and (ii) retention arm 450 and front wall 400, is about 2:3. In other embodiments, retention arm 450 is located at a substantially equal distance from rear wall 420 and front wall 440. Referring to FIGS. 15 and 16, retention arm 450 can hold two carrier packages 10 upright in the rear of display tray 400, while leaving room to hold three more carrier packages 10 upright to the front of retention arm 450 of display tray 400.

Figure 12:
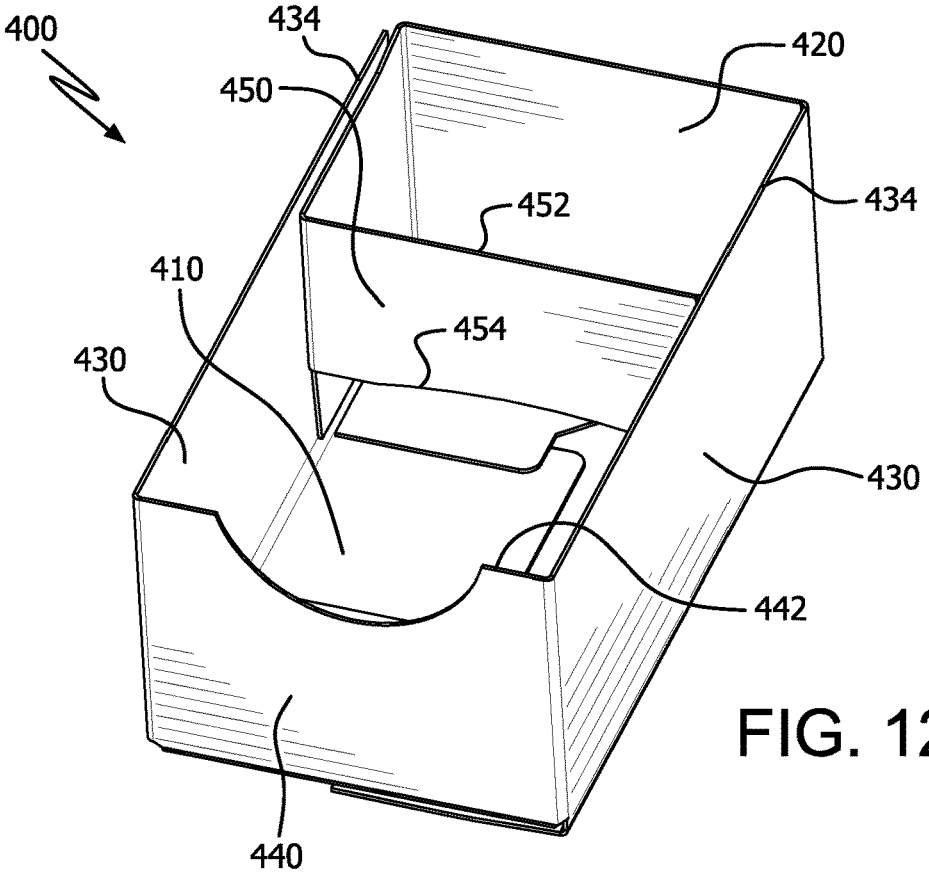
FIG. 12 shows a front perspective view of a display tray for holding multiple carrier packages.
Figure 13:
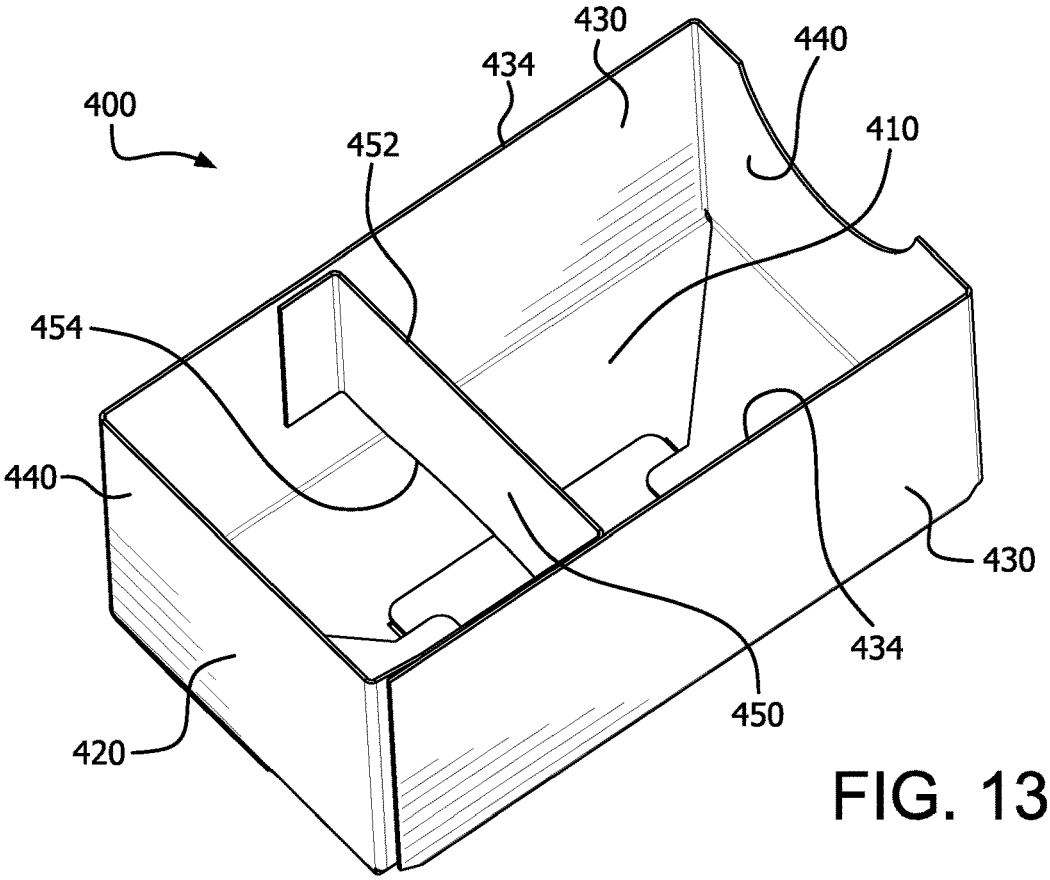
FIG. 13 shows a rear perspective view of the display tray of FIG. 12.
Figure 14:
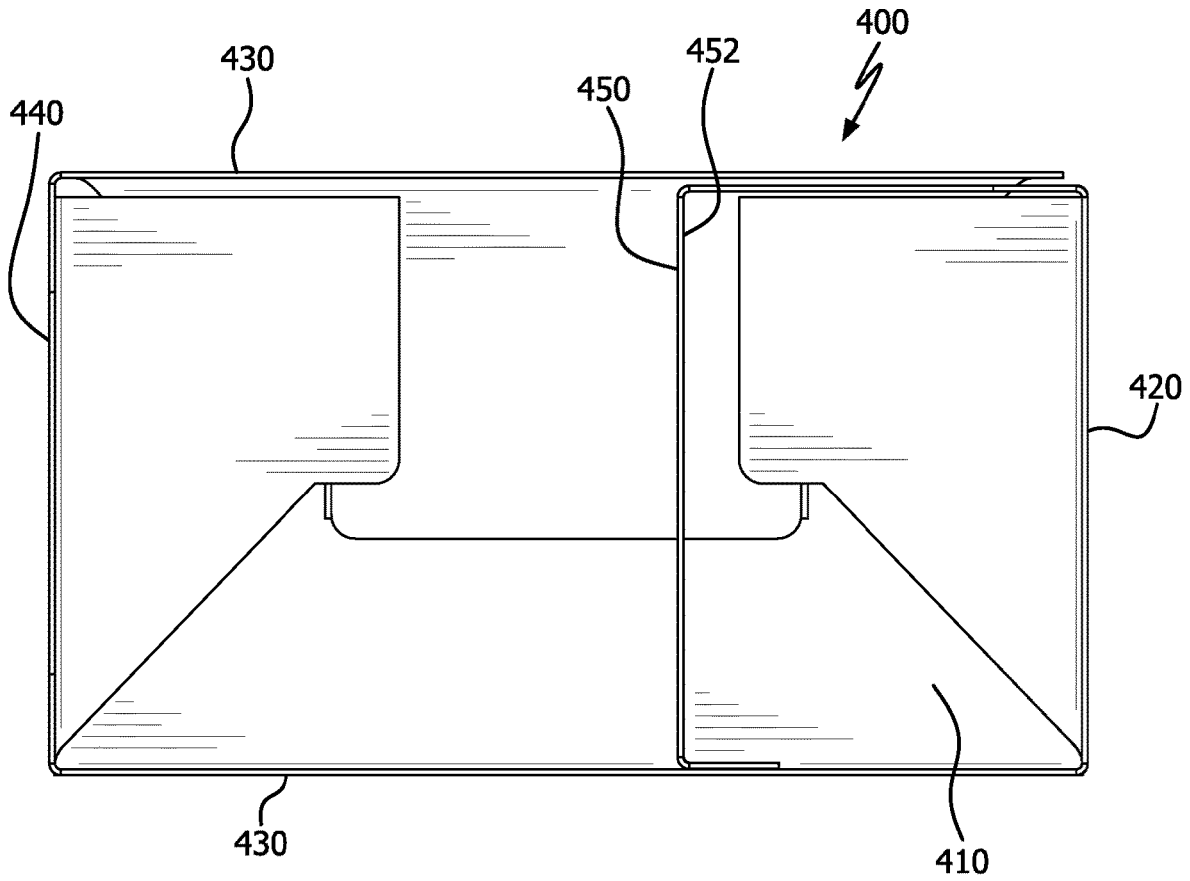
FIG. 14 shows a top view of the display tray of FIG. 12.

Referring to FIGS. 12-16, the height of each front wall 440 is the distance from base 410 to top edge 442 of front wall 440. The height of the retention arm 450 is the distance between top edge 452 of retention wall 450 and bottom edge 454 of retention wall 450. Both top edge 452 and bottom edge 454 are connected to either sidewalls 430 or base 410. Referring to FIGS. 12 and 13, the height of retention arm 450 is less than the height of sidewalls 430.

Referring to FIGS. 12 and 13, the height of each sidewall 430 is the distance from base 410 to top edge 434 of side wall 430. The height of retention arm 450 is the distance between (i) top edge 452 of retention wall 450 and (ii) bottom edge 454 of retention wall 450. Both top edge 452 and bottom edge 454 are connected to either sidewalls 430 or base 410. The height of retention arm 450 is less than or equal to the height of sidewalls 430.

Carrier 100, 200 and display tray 400 can be made from paper-based sheet material including, but not limited to, paperboard, cardboard, kraft board, corrugated cardboard, carton board, paperboard laminates, or a combination thereof. Carrier 100, 200 and display tray 400 can made from any of the foregoing paper-based materials having a thickness of no less than about 16 point, i.e., 0.016 of an inch. In other embodiments, the thickness of the paper-based materials can be more than 16 point and up to about 20 point, i.e., 0.020 of an inch, or thicker, so long as the thickness provides the desired structural stability for carrier 100, 200, as is consistent with the operability of the invention.

In alternative embodiments, carrier 100, 200 and display tray 400 can be made by a rigid or semi-rigid plastic material.

Figure 27:
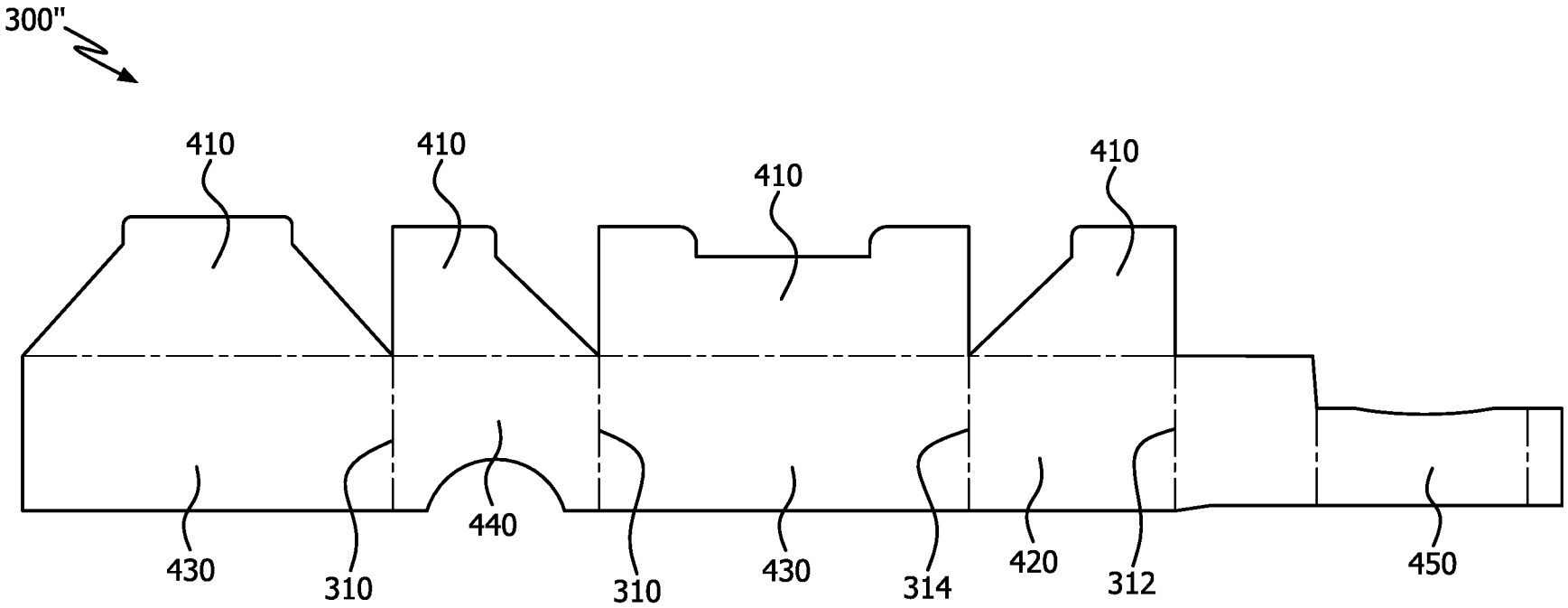
FIG. 27 shows a die-cut blank for the display tray of FIG. 12.
Figure 29:
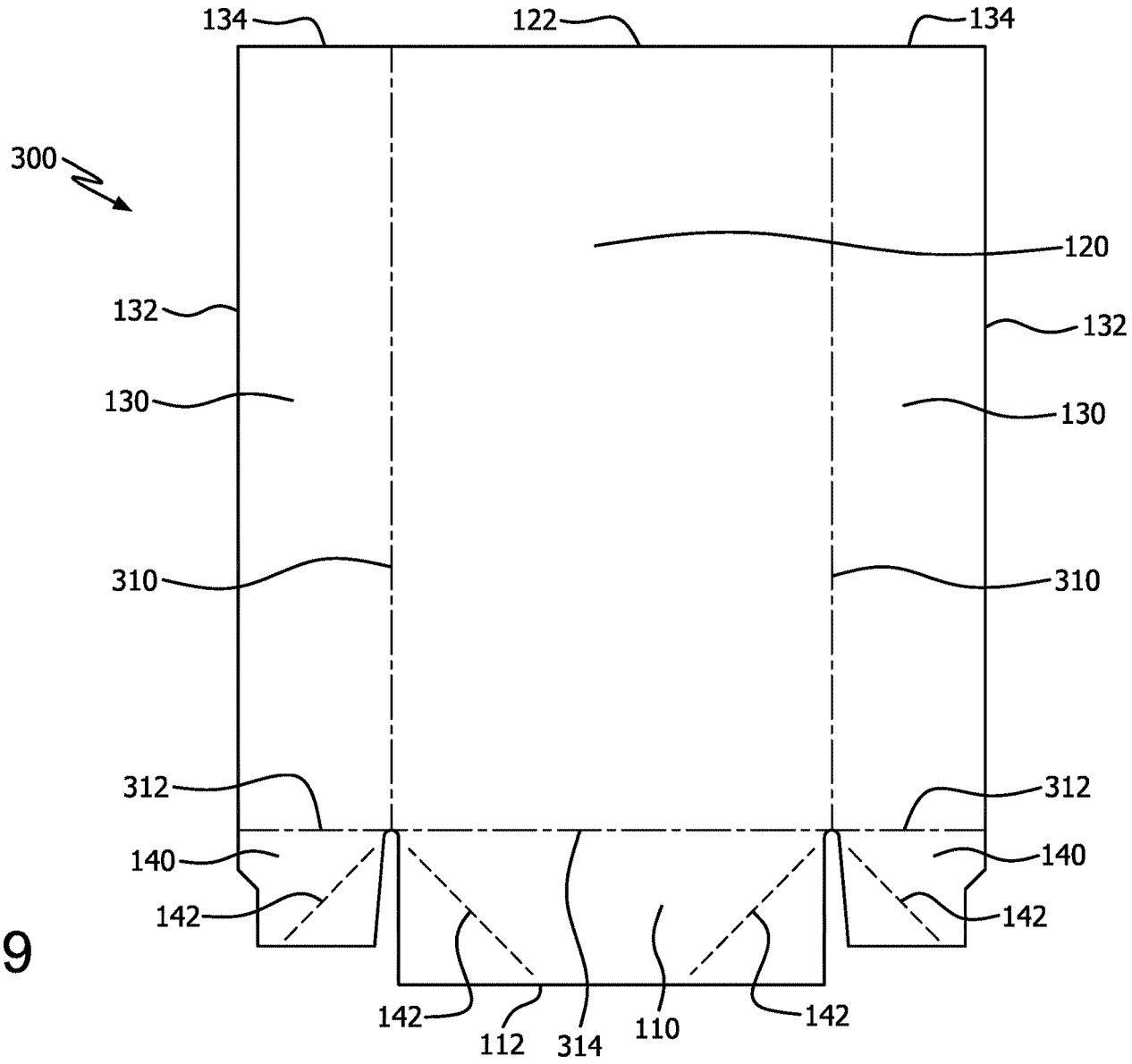
FIG. 29 shows a die-cut blank for the carrier of FIG. 1.

Carrier 100, 200 and display tray 400 can be die cut from paper-based or plastic materials into pre-formed blanks 300, 300', and 300", respectively, as shown in FIGS. 27, 28, and 29, and then formed by adhering tabs 140, 240 to base wall 110, 210. After being formed, carrier 100, 200 and display tray 400 can be folded down for efficient storage. Once formed and folded for storage, carrier 100, 200 and display tray 400 can be bundled and later unbundled and unfolded in preparation for assembly of carrier 100, 200 and display tray 400 during the packing process of irregular-shaped products 150.

Carrier 100, 200 and display tray 400 can be configured with color and graphics that are aesthetically pleasing and eye-appealing to encourage consumers to view and consider the irregular-shaped 150, 250 products. Marketing communications and graphic design can be applied to the surface of carrier 100, 200 and/or display tray 400, which may be coordinated with any graphics, color, and transparency of wrap 180.

Referring now to FIG. 27, display tray 400 shown in FIGS. 12 and 13 can be formed by the following steps. First, sidewalls 430 are formed by folding sidewalls 430 along the first fold lines 310. Second, retention arm 450 is folded against rear wall 420 along second fold line 312. Third, rear wall 420 is folded inward along third fold line 314. Fourth, base 410 is formed from the tabs extending from front wall 410, rear wall 420 and sidewalls 430. Fifth, retention arm 450 is folded back along fourth fold line 316 and connected to sidewall 430.

Referring now to FIG. 28, carrier 200 of FIG. 17 can be formed by the following steps. First, divider 260 is formed by folding the two portions adjacent to central score line 262 onto themselves. Second, sidewalls 230 are folded up along first fold line 310. Third, tabs 240 are folded inward toward each other along second fold lines 312. Third, sub-footings 211, 212 are overlapped as footing 210 is folded up along third fold line 314. Footing 210 can be secured to tabs 240 with a fastener, an adhesive, or both. In other embodiments, when it is desired that tabs 240 be secured below footing 210, the third and fourth steps described above are reversed. Optionally, once carrier 200 is assembled, divider 260 can be folded to a side, and footing 210 and tabs 240 can be folded inward against rear wall 220 along score lines 142, thereby collapsing carrier 200 for storage before later use in assembling carrier package 10.

Referring now to FIG. 29, carrier 100 of FIG. 1 can be formed by the following steps. First, sidewalls 130 are folded up along first fold lines 310. Second, tabs 140 are folded inward toward each other along second fold lines 312. Third, footing 110 is folded up along third fold line 314. Footing 110 can be secured to tabs 140 with a fastener or with adhesive. In other embodiments, when it is desired that tabs 140 be secured below footing 110, the second and third steps described above are reversed. Optionally, once carrier 100 is assembled, footing 110 and tabs 140 can be folded inward against rear wall 120 along score lines 142, thereby collapsing carrier 100 for storage before later use in assembling carrier package 10.

Also described herein are methods for packing irregular-shaped products 150, 250. In a non-limiting embodiment, a method for packing carrier 100, 200 with at least one irregular-shaped product 150, 250 are provided with the invention. The method includes the step of either forming carrier 100, 200 (if not pre-formed as disclosed) or unfolding a pre-formed carrier 100, 200 into its predetermined 3-dimensional shape.

The next step of the method for packing the carrier 100, 200 includes placing at least one irregular-shaped product 150, 250 in the carrier 100, 200, depending on the type of carrier 100, 200 used. If carrier 100 is used, then this step includes aligning a first irregular-shaped product 150 in the lower portion of packing compartment of carrier 100, whereby an end of the product 150 contacts footing 110 and optionally a side wall 130. This step includes aligning a second irregular-shaped product 150 in a position that is opposite that of the first irregular-shaped product 150, whereby first and second irregular-shaped products 150 are interlocked, or nested together, in a manner than minimizes empty space in the packing compartment of carrier 100. The two irregular-shaped products 150 can be nested before placement in packing compartment of carrier 100. Alternatively, if carrier 200 is being used, then the step includes placing two irregular-shaped products 250 individually aligned and separated by divider 260 in each of the packing compartments.

The next step of the method for packing carrier 100, 200 includes enclosing carrier 100, 200 with irregular-shaped products 150, 250 aligned in packing compartments. The enclosing step comprises wrapping carrier 100, 200 with wrap 180 that is sized in a manner to secure irregular-shaped products 150, 250 in packing compartments, while maintaining the overall 3-dimensional shape of carrier 100, 200. Wrap 180 can be a tube-shaped plastic material that surrounds carrier 100, 200, and then is sealed at each end to form the carrier package. Alternatively, wrap 180 can be folded in a manner that is consistent with the shape and size of carrier 100, 200 to form carrier package 10.

The next step of the method for packing carrier packages 10 includes packing multiple carrier packages 10 in a container. In an embodiment, multiple carrier packages 10 can be packaged in display trays 400, which are then packaged in larger containers.

While the subject matter has been disclosed with reference to specific embodiments, it will be apparent that other embodiments and variations can be devised by those skilled in the art without departing from the true spirit and scope of the subject matter described herein. The appended claims include all such embodiments and equivalent variations.

What is claimed is:

1. A package containing at least one irregular-shaped consumable product, the package comprising:

a carrier formed from a rigid or semi-rigid, foldable sheet material, the carrier comprising a footing opposite an opening and a vertical support member, the footing and the vertical support member define a compartment that holds and partially encloses the at least one irregular-shaped consumable product with minimal empty space in the compartment, the footing having a uniform footing depth, and the vertical support member comprising:

a pair of sidewalls each having a top edge opposite the footing and uniform sidewall depth facing one another having lower tabs joined to opposite ends of the footing, a rear wall being generally flat with a lower edge contiguous with the footing, and an upper edge opposite the lower edge, wherein the top edge and upper edge define the opening; and a wrap that encloses the at least one irregular-shaped consumable product aligned in the carrier, the wrap configured to maintain the at least one irregular-shaped consumable product within the carrier;

wherein the uniform footing depth is equal to the uniform sidewall depth, the carrier provides support to stand the at least one irregular-shaped consumable product upright in the package for display; and wherein the footing is adapted to permit the package to stand upright on the footing.

2. The package of claim 1 wherein the irregular-shaped consumable product comprises an elongate shape.

3. The package of claim 1 wherein the carrier is made from a paper-based material selected from paperboard, cardboard, kraft board, corrugated cardboard, or carton board.

4. The package of claim 1 wherein the carrier is made from a plastic material selected from polypropylene, polyethylene terephthalate, high density polyethylene, polystyrene, or polyvinyl chloride.

5. The package of claim 1 wherein the footing, the sidewalls, and the rear wall have a 3-dimensional shape that is square or rectangular.

6. The package of claim 1 wherein the wrap is made from a plastic material.

7. The package of claim 1 wherein the wrap is transparent.

8. The package of claim 1 wherein the wrap is hermetically sealed.

* * * * *